US006398884B1

(12) United States Patent
Kyono et al.

(10) Patent No.: US 6,398,884 B1
(45) Date of Patent: Jun. 4, 2002

(54) METHODS OF PRODUCING STEEL PLATE, HOT-DIP STEEL PLATE AND ALLOYED HOT-DIP STEEL PLATE

(75) Inventors: Kazuaki Kyono; Shigeru Umino; Akio Tosaka; Keiji Nishimura; Hiromasa Hayashi, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/673,626

(22) PCT Filed: Feb. 21, 2000

(86) PCT No.: PCT/JP00/00975

§ 371 (c)(1),
(2), (4) Date: Oct. 19, 2000

(87) PCT Pub. No.: WO00/50659

PCT Pub. Date: Aug. 31, 2000

(30) Foreign Application Priority Data

| | | |
|---|---|---|
| Feb. 25, 1999 | (JP) | 11-48142 |
| Mar. 3, 1999 | (JP) | 11-55058 |
| Apr. 20, 1999 | (JP) | 11-112214 |
| Nov. 12, 1999 | (JP) | 11-322537 |

(51) Int. Cl.[7] ..... C21D 8/02
(52) U.S. Cl. ..... 148/537; 148/651; 148/653
(58) Field of Search ..... 148/537, 651, 148/653

(56) References Cited

FOREIGN PATENT DOCUMENTS

JP 409041110 A * 2/1997

* cited by examiner

*Primary Examiner*—Deborah Yee
(74) *Attorney, Agent, or Firm*—Oliff & Berridge, PLC

(57) ABSTRACT

This invention can form a sufficiently internal oxide layer in a surface layer portion of an iron matrix of a steel sheet by hot rolling a base steel and subjecting to a heat treatment at a temperature range of 650–950° C. in an atmosphere substantially not causing reduction while being adhered with a black skin scale irrespectively of a chemical steel composition or production history, or even when a radiation type heating of a radial tube or the like is used in a recrystallization annealing before a hot dipping treatment, and hence excellent hot-dipping property and conversion treating property can be given to a steel sheet for hot dipping.

9 Claims, 12 Drawing Sheets

A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet White skin hot rolled steel sheet;Atmosphere 100vol%$N_2$ Black skin hot rolled steel sheet;Atmosphere 100vol%$N_2$ Black skin hot rolled steel sheet;Atmosphere 5vol%$H_2$-$N_2$ 10 μm

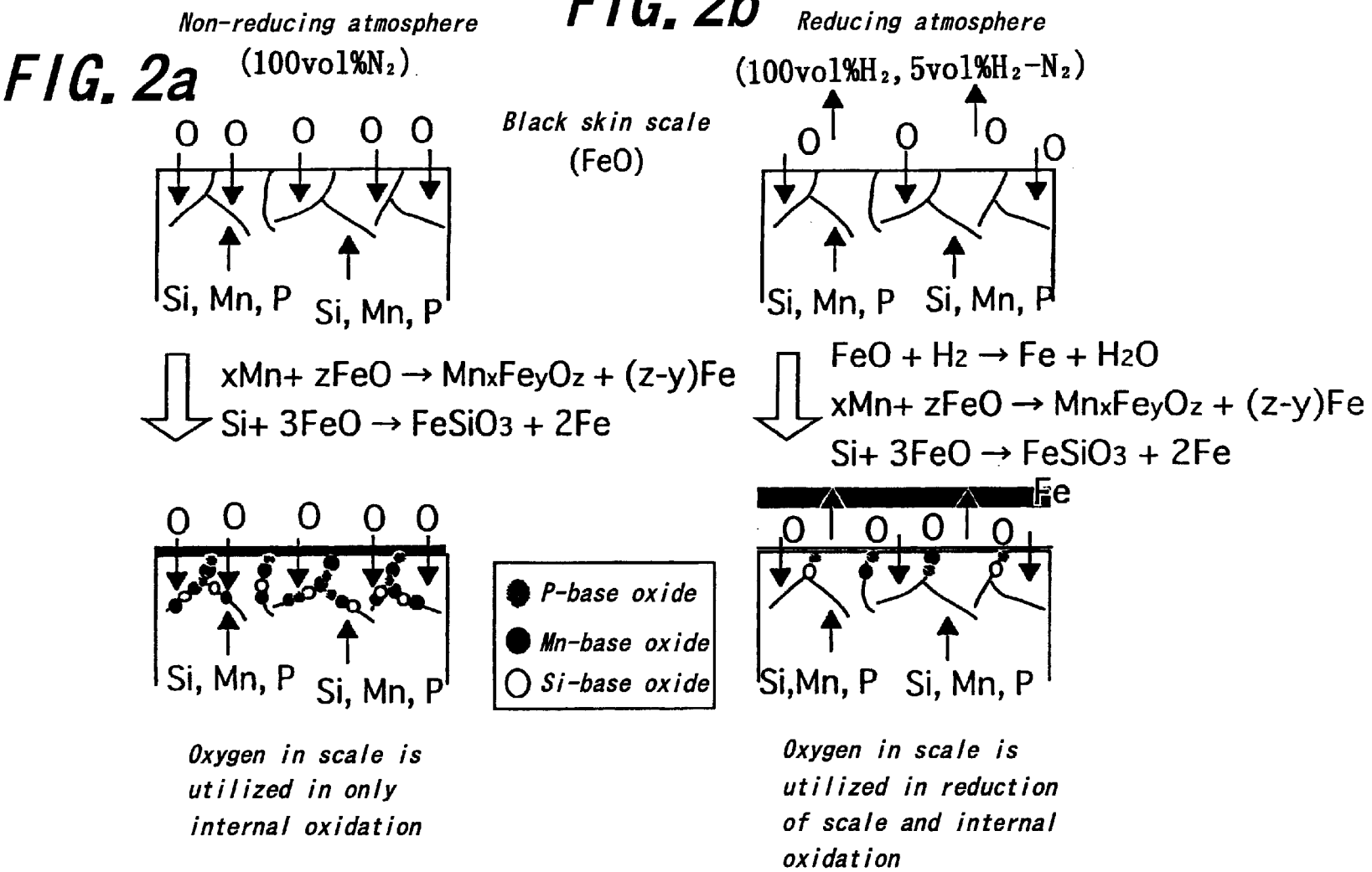
FIG. 2a
Non-reducing atmosphere
(100vol%N2)
Si, Mn, P
Si, Mn, P
xMn+ zFeO → MnxFeyOz + (z-y)Fe
Si+ 3FeO → FeSiO3 + 2Fe
Oxygen in scale is utilized in only internal oxidation
FIG. 2b
Black skin scale
(FeO)
Reducing atmosphere
(100vol%H2, 5vol%H2-N2)
Si, Mn, P
Si, Mn, P
FeO + H2 → Fe + H2O
xMn+ zFeO → MnxFeyOz + (z-y)Fe
Si+ 3FeO → FeSiO3 + 2Fe
Fe
Si,Mn, P
Si, Mn, P
Oxygen in scale is utilized in reduction of scale and internal oxidation
P-base oxide
Mn-base oxide
Si-base oxide A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet FIG. 8a No heat treatment
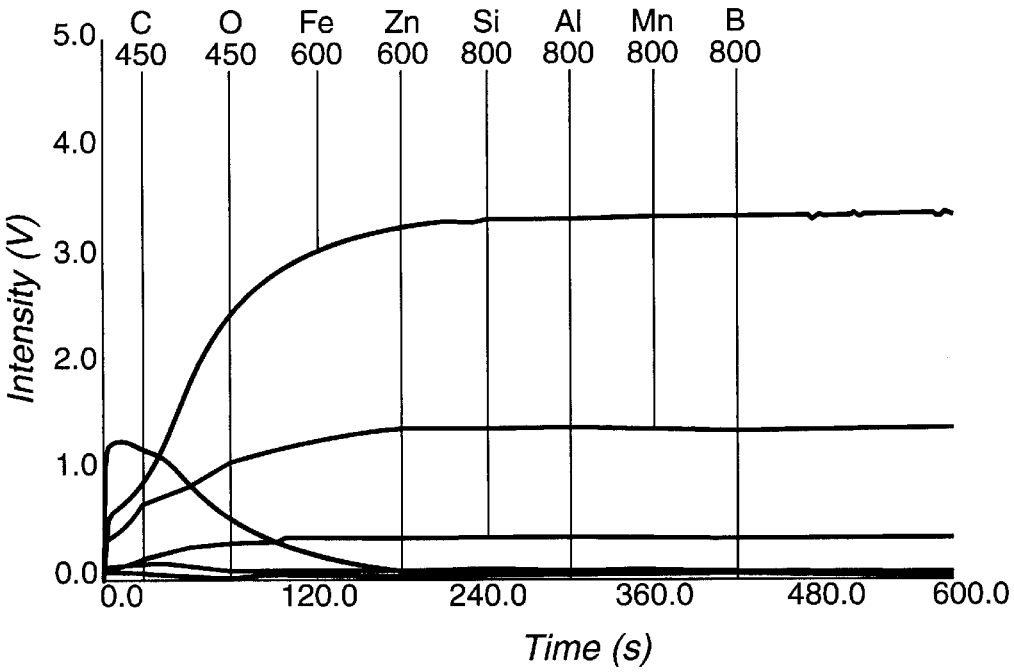
FIG. 8b Heat Treatment ($100\%N_2$)
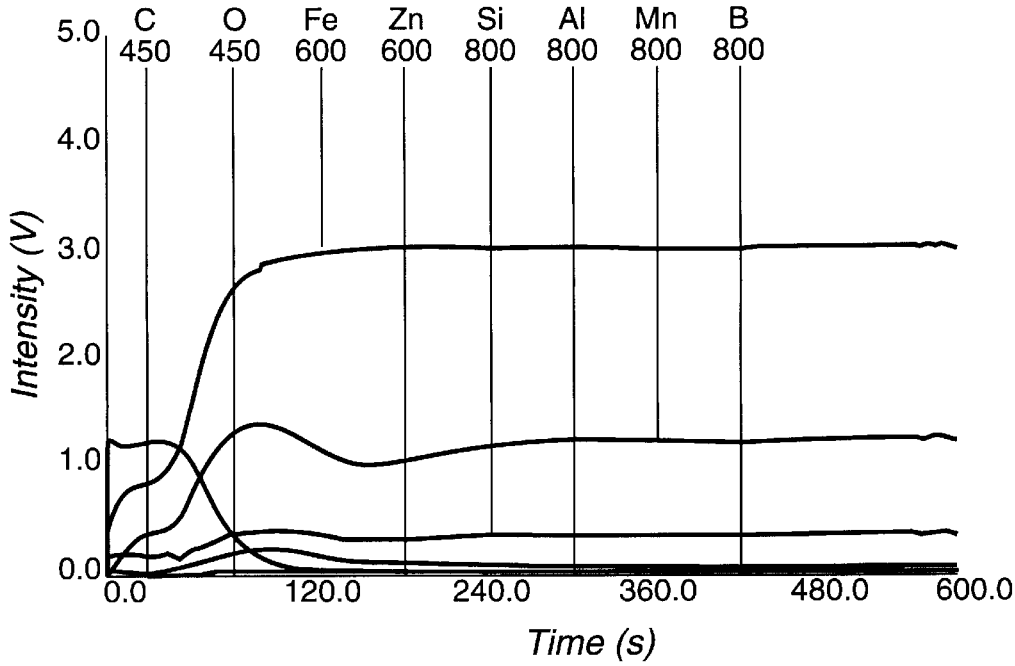

After heat treatment of black skin hot rolled steel sheet (800℃×10Hr)

After cold rolling

After cold rolling and annealing (880℃×40s)

10 μm

A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet A. Heat-treated material of black skin hot rolled steel sheet(100vol%$N_2$)
B. Heat-treated material of black skin hot rolled steel sheet(5vol%$H_2$-$N_2$)
C. Heat-treated material of black skin hot rolled steel sheet(100vol%$H_2$)
D. Heat-treated material of white skin hot rolled steel sheet

METHODS OF PRODUCING STEEL PLATE, HOT-DIP STEEL PLATE AND ALLOYED HOT-DIP STEEL PLATE

TECHNICAL FIELD

This invention relates to steel sheets, hot-dipped steel sheets and alloyed hot-dipped steel sheets suitable for use in automobile parts and the like as well as a method of producing the same, and particularly is to advantageously improve the hot dipping property and conversion treating property.

BACKGROUND ART

In automobile members, it is recently intended to increase the strength from a viewpoint that a weight of a vehicle body is reduced and a reliability and a safeness are improved. At the same time, the improvement of formability is demanded.

This tendency is also true in hot-dipped steel sheets and alloyed hot-dipped steel sheets such as galvanized steel sheets, alloyed galvanized steel sheets, frequently used as a steel sheet for automobiles and then, many methods haven been proposed for increasing strength of these steels.

For example, JP-A-59-193221 proposes a method for increasing the strength of the steel sheet by adding a relatively large amount of a solid-solution strengthening element such as Si, Mn or the like.

In this method, however, there are caused another problems resulted from the addition of the greater amount of Si or Mn, i.e. degradation of hot-dipping property due to the surface enrichment of Si or Mn (formation of portion not hot-dipped or occurrence of bare spot) and degradation of conversion treating property (no formation of chemical conversion coatings such as zinc phosphate or the like applied onto a cold rolled steel sheet as an undercoating treatment), so that the resulting steel sheets can not be put into practical use.

And also, high-strength cold rolled steel sheets and high-strength galvanized steel sheets having a deep drawability improved by subjecting to α-region lubrication rolling at a hot finish temperature of not lower than 500° C. but not higher than Ar3 transformation point are proposed in JP-A-5-339643.

In this way, the excellent deep drawability is surely obtained, but the degradation of the hot-dipping property is not avoided in the galvanization.

As a countermeasure for solving the above problems, there are proposed a method wherein a steel sheet is forcedly oxidized under a high oxygen partial pressure and subjected to reduction and hot dipping (JP-A-55-122865), a method wherein a pre-plating is carried out before the hot dipping (JP-A-58-104163) and the like. In these methods, however, the control of surface oxide in the heat treatment is not sufficient, so that stable hot-dipping property and conversion treating property are not always obtained in accordance with the chemical composition of steel and the plating conditions, and also an extra process is added to increase the production cost.

Furthermore, JP-A-9-310163 proposes a method wherein a high-temperature coiling is carried out after the hot rolling to form an oxide in a crystal grain boundary or an inside of a crystal grain at a surface layer portion of a matrix in the steel sheet or form an internal oxide layer for improving the aforementioned degradation of the hot-dipping property.

Such a method of forming the internal oxide layer is very useful as a method for preventing the occurrence of bare spot.

In the above method, however, the sufficient internal oxide layer can not be ensured in accordance with the kind of steel or the production history, so that there is remained a problem that excellent hot-dipping property and conversion treating property are not necessarily obtained to a satisfactory level.

Particularly, this tendency is large when recrystallization annealing before the hot dipping is carried out in a radiation type heating system such as a radiant tube or the like.

Moreover, when the heating system is a direct heating system, the internal oxide layer is somewhat strengthened during the annealing, so that the properties are improved as compared with the radiation type heating system, but it is difficult to stably form the desired internal oxide layer.

Lately, hot rolled steel sheets are used instead of the conventional cold rolled steel sheet as a part of the automobile members.

In the hot rolled steel sheet, the recrystallization annealing as in the cold rolled steel sheet is not required, so that it is considered that the surface enrichment of Si or Mn mainly produced in the recrystallization annealing and the occurrence of troubles resulted from such a surface enrichment are less.

However, when the hot-dipping property and conversion treating property are examined with respect to the actual hot rolled steel sheets, the sufficiently satisfactory results are not obtained.

The invention is to advantageously solve the aforementioned problems.

That is, a first object of the invention is to propose steel sheets, hot-dipped steel sheets and alloyed hot-dipped steel sheets capable of stably developing the excellent hot-dipping property and conversion treating property when being used as a hot rolled steel sheet as well as a method of advantageously producing the same.

And also, a second object of the invention is to propose steel sheets, hot-dipped steel sheets and alloyed hot-dipped steel sheets capable of stably developing the excellent hot-dipping property and conversion treating property irrespectively of a chemical steel composition and production history when being used as a cold rolled steel sheet and even when a radiation type heating such as a radiant tube or the like is used in the recrystallization annealing before a hot dipping treatment as well as a method of advantageously producing the same.

Furthermore, a third object of the invention is to propose steel sheets, hot-dipped steel sheets and alloyed hot-dipped steel sheets having the excellent hot-dipping property and conversion treating property and an excellent workability with respect to a cold rolled steel sheet particularly improving the workability among these cold rolled steel sheets as well as a method of advantageously producing the same.

Moreover, the "conversion treating property" used in the invention means an ability forming chemical conversion coatings such as zinc phosphate or the like when the steel sheet is used as an automobile member as it is.

DISCLOSURE OF INVENTION

As mentioned above, the cause degrading the hot-dipping property and conversion treating property when a greater amount of Si or Mn is added is the surface enrichment of Si or Mn in the annealing (Si or Mn is selectively oxidized during the annealing to largely appear on the surface).

And also, it has been elucidated in the hot rolled steel sheets that an essential cause lies in the surviving of oxides of Si, Mn, P and the like on the surface of the hot rolled steel sheet after pickling in addition to the surface enrichment of Si or Mn in the heating before the hot dipping as previously mentioned. This cause is considered due to the fact that the oxides of Si, P and the like and composite oxide thereof with iron are hardly dissolved in the pickling.

As a solution for the above problem, therefore, it is considered that converting an outermost surface layer of iron matrix into an iron layer containing less of a solid solution element such as Si, Mn or the like is effective.

Now, the inventors have made various studies in order to achieve the above object, and found out that it is advantageous that an internal oxide layer is formed in the vicinity of a surface of an iron matrix, namely in a surface layer portion of the iron matrix, to enclose Si, Mn, P or the like on the surface of the iron matrix as an element forming the internal oxide layer in the inside thereof, and that it is very effective to conduct a heat treatment in an atmosphere substantially not causing reduction while being adhered with a black skin scale after the hot rolling for sufficiently and stably forming the above internal oxide layer.

The invention is based on the above knowledge.

That is, the gist and construction of the invention are as follows.

1. A hot rolled steel sheet characterized by subjecting a base steel after a hot rolling to a heat treatment at a temperature range of 650–950° C. in an atmosphere substantially not causing reduction while being adhered with a black skin scale to form an internal oxide layer in a surface layer portion of an iron matrix of the steel sheet and then pickling it.
2. A hot-dipped steel sheet characterized by providing a hot-dipped layer on the surface of the hot rolled steel sheet described in the item 1.
3. An alloyed hot-dipped steel sheet characterized by providing an alloyed hot-dipped layer on the surface of the hot rolled steel sheet described in the item 1.
4. A method of producing a hot rolled steel sheet by hot rolling a base steel and then subjecting to a pickling, characterized in that the steel sheet after the hot rolling is subjected to a heat treatment at a temperature range of 650–950° C. in an atmosphere substantially not causing reduction while being adhered with a black skin scale to form an internal oxide layer in a surface layer portion of an iron matrix of the steel sheet.
5. A method of producing a hot-dipped steel sheet, characterized in that the surface of the hot rolled steel sheet described in the item 4 is subjected to a hot dipping.
6. A method of producing an alloyed hot-dipped steel sheet, characterized in that the surface of the hot rolled steel sheet described in the item 4 is subjected to a hot dipping and further to an alloying treatment by heating.
7. A cold rolled steel sheet characterized by subjecting a base steel after a hot rolling to a heat treatment at a temperature range of 650–950° C. in an atmosphere substantially not causing reduction while being adhered with a black skin scale to form an internal oxide layer in a surface layer portion of an iron matrix of the steel sheet and then subjecting to a pickling, a cold rolling and a recrystallization annealing.
8. A hot-dipped steel sheet characterized by providing a hot-dipped layer on the surface of the cold rolled steel sheet described in the item 7.
9. An alloyed hot-dipped steel sheet characterized by providing an alloyed hot-dipped layer on the surface of the cold rolled steel sheet described in the item 7.
10. A method of producing a cold rolled steel sheet by hot rolling a base steel and then subjecting to a pickling, a cold rolling and a recrystallization annealing, characterized in that the steel sheet after the hot rolling is subjected to a heat treatment at a temperature range of 650–950° C. in an atmosphere substantially not causing reduction while being adhered with a black skin scale to form an internal oxide layer in a surface layer portion of an iron matrix of the steel sheet.
11. A method of producing a hot-dipped steel sheet, characterized in that the surface of the cold rolled steel sheet described in the item 10 is subjected to a hot dipping.
12. A method of producing an alloyed hot-dipped steel sheet, characterized in that the surface of the cold rolled steel sheet described in the item 10 is subjected to a hot dipping and further to an alloying treatment by heating.
13. A hot-dipped steel sheet described in the item 2 or 8, characterized in that it is a high-strength steel sheet having a composition of Mn: 0.2–3.0 mass % or Mn; 0.2–3.0 mass % and Si: 0.1–2.0 mass % and provided on its surface with a hot-dipped layer, and a surface layer portion of an iron matrix just beneath the hot-dipped layer has an enriched layer of Mn or an enriched layer of Mn and Si.
14. A hot-dipped steel sheet described in the item 13, characterized by having such a profile that Mn concentration or Mn and Si concentrations from the surface in a thickness direction rapidly rises over the hot-dipped layer and lowers at once and thereafter somewhat rises to render into a steady state.
15. A hot-dipped steel sheet described in the item 13, characterized in that Mn/Fe ratio or Mn/Fe ratio and Si/Fe ratio in the surface layer portion of the iron matrix just beneath the hot-dipped layer is not less than 1.01 times each of Mn/Fe ratio or Mn/Fe ratio and Si/Fe ratio in the inside of the iron matrix.
16. An alloyed hot-dipped steel sheet described in the item 3 or 9, characterized in that it is a high-strength steel sheet having a composition of Mn: 0.2–3.0 mass % or Mn: 0.2–3.0 mass % and Si: 0.1–2.0 mass % and provided on its surface with an alloyed hot-dipped layer, and a surface layer portion of an iron matrix just beneath the alloyed hot-dipped layer has an enriched layer of Mn or an enriched layer of Mn and Si.
17. An alloyed hot-dipped steel sheet described in the item 16, characterized by having such a profile that Mn concentration or Mn and Si concentrations from the surface in a thickness direction rapidly rises over the hot-dipped layer and lowers at once and thereafter somewhat rises to render into a steady state.
18. An alloyed hot-dipped steel sheet described in the item 16, characterized in that Mn/Fe ratio or Mn/Fe ratio and Si/Fe ratio in the surface layer portion of the iron matrix just beneath the hot-dipped layer is not less than 1.01 times each of Mn/Fe ratio or Mn/Fe ratio and Si/Fe ratio in the inside of the iron matrix.
19. A cold rolled steel sheet having an excellent workability, characterized in that the sheet has a composition comprising C: 0.0005–0.005 mass %, Si: not more than 1.5 mass %, Mn: not more than 2.5 mass %, Al: not more than 0.1 mass %, P: not more than 0.10 mass %, S: not more than 0.02 mass %, N: not more than 0.005 mass % and one or more of Ti: 0.010–0.100 mass % and Nb: 0.001–0.100 mass % the remainder being Fe and inevitable impurities, and a Lankford value (r-value) of not less than 2 and is provided on a surface layer portion of its iron matrix with an internal oxide layer.
20. A hot-dipped steel sheet having an excellent workability, characterized by providing a hot-dipped layer on the surface of the cold rolled steel sheet described in the item 19.

21. An alloyed hot-dipped steel sheet having an excellent workability, characterized by providing an alloyed hot-dipped layer on the surface of the cold rolled steel sheet described in the item 19.
22. A method of producing a cold rolled steel sheet having an excellent workability, characterized in that a steel comprising C: 0.0005–0.005 mass %, Si: not more than 1.5 mass %, Mn: not more than 2.5 mass %, Al: not more than 0.1 mass %, P: not more than 0.10 mass %, S: not more than 0.02 mass %, N: not more than 0.005 mass % and one or more of Ti: 0.010–0.100 mass % and Nb: 0.001–0.100 mass % and the remainder being Fe and inevitable impurities is subjected to a rough hot rolling under a condition of finish rolling temperature: not lower than $Ar_3$ transformation point but not higher than 950° C. and to a hot finish rolling through lubrication rolling under conditions of finish rolling temperature: not lower than 500° C. but not higher than $Ar_3$ transformation point and rolling reduction: not less than 80%, and then a steel sheet after the hot finish rolling is subjected to a heat treatment at a temperature range of 650–950° C. in an atmosphere substantially not causing reduction while being adhered with a black skin scale to form an internal oxide layer in a surface layer portion of an iron matrix of the steel sheet, pickled to remove the black skin scale, and subjected to a cold rolling at a rolling reduction: 50–90% and further to a recrystallization annealing at a temperature of not lower than a recrystallization temperature but not higher than 950° C.
23. A method of producing a hot-dipped steel sheet having an excellent workability, characterized by subjecting the surface of the cold rolled steel sheet described in the item 22 to a hot dipping.
24. A method of producing an alloyed hot-dipped steel sheet having an excellent workability, characterized by subjecting the surface of the cold rolled steel sheet described in the item 22 to a hot dipping and further to an alloying treatment by heating.

The invention will concretely be described below.

Firstly, experimental results laying the foundation of the invention are described with respect to a hot rolled steel sheet as a target of the steel sheet.

In FIG. 1 are shown comparative results of sections of hot rolled steel sheets after heat treatment as observed by an optical microscope with respect to a hot rolled steel sheet previously removing black skin scale through pickling or so-called white skin hot rolled steel sheet (FIG. 1(*a*)) and hot rolled steel sheets adhered with black skin scale or so-called black skin hot rolled steel sheets (FIGS. 1(*b*), (*c*)). The black skin scale is a scale mainly composed of wustite (FeO) and having a blackish appearance.

Moreover, Si—Mn steel containing Si: 0.5 mass % and Mn: 1.5 mass % is used as a starting material, and heat treating conditions for the hot rolled steel sheet are 750° C. and 5 hours.

As shown in FIG. 1, when the hot rolled steel sheet is subjected to the heat treatment while being adhered with the black skin scale (FIGS. 1(*b*), (*c*)), the formation of the internal oxide layer is recognized in the surface layer portion of iron matrix in the steel sheet.

Moreover, when the heat treating atmosphere is 100 vol % $N_2$ (atmosphere substantially not causing reduction: FIG. 1(*b*)), the formation of reduced iron is hardly recognized at an interface between the black skin scale surface and the iron matrix, while when it is 5 vol % $H_2$—$N_2$ (atmosphere somewhat causing reduction: FIG. 1(*c*)), the formation of reduced iron is observed at an interface between a part of the black skin scale surface and the iron matrix.

On the other hand, the formation of the internal oxide layer is not observed in case of the white skin hot rolled steel sheet at all.

Although investigation is conducted with respect to a case that the black skin hot rolled steel sheet is subjected to the heat treatment in 100 vol % $H_2$ atmosphere (strong reducing atmosphere), the reduction of the black skin scale itself proceeds, but the formation of the internal oxide layer hardly occurs. And also, oxides of Si, Mn, P and the like remain in the reduced iron.

As mentioned above, it is clear that the formation of the internal oxide layer in the hot rolled steel sheet is largely influenced by the atmosphere in the heat treatment of the hot rolled steel sheet.

In FIG. 2 is schematically shown an influence of an atmosphere in the heat treatment of the black skin hot rolled steel sheet upon the formation of the internal oxide layer.

As shown in FIG. 2(*a*), when the heat treatment is carried out in the non-reducing (substantially not causing reduction) atmosphere (for example, 100 vol % $N_2$ atmosphere), oxygen in the black skin scale mainly penetrates along a crystal grain boundary to form $FeSiO_3$ or $Mn_xFe_yO_z$. That is, the oxygen in the scale is considered to be used in only the formation of the internal oxide layer.

On the contrary, as shown in FIG. 2(*b*), in case of reducing (substantially causing reduction) atmosphere (for example, 100 vol % $H_2$ or 5 vol % $H_2$—$N_2$ atmosphere), oxygen in the black skin scale is used in not only the formation of the internal oxide layer but also the reduction of the black skin scale ($FeO+H_2 \rightarrow Fe+H_2O$), so that the formation of the internal oxide layer is insufficient and the black skin scale layer is reduced to undesirably form reduced iron containing oxides of Si, Mn and the like.

In FIGS. 3(*a*), (*b*) are shown comparative results examined on elementary distribution in a depth direction through GDS (Grimm-Grow's spectral analysis) after the pickling with respect to a black skin hot rolled steel sheet having a composition of 0.08 mass % C-1.0 mass % Si-1.5 mass % Mn-0.07 mass % P heat-treated in nitrogen and a comparative material not heat-treated.

As shown in FIG. 3(*b*), Si, Mn and the like in the comparative material are metallic state and homogeneous in the inside of the steel sheet, but Si concentration as a residue of the oxide increases in the surface layer.

On the other hand, in case of the heat-treated material of the black skin hot rolled steel sheet in nitrogen as shown in FIG. 3(*a*), peaks by the oxides of Si, Mn and the like are observed in the inside of the surface layer of the iron matrix, from which it is understood that the metallic elements are enclosed in the inside as an oxide. They are oxides in the internal oxide layer and solid solution concentration as a metallic element considerably lowers. And also, it is understood that the metallic elements such as Si, Mn and the like in the outermost surface layer considerably decrease as compared with the inside of the iron matrix and the comparative material and hence the outermost surface layer is an iron layer largely decreasing solid solution amount of easily-oxidizable metallic element.

Moreover, both of internal oxidation and surface oxidation may be caused as an oxidation behavior, so that a mechanism of decreasing Si, Mn or the like in the outermost surface layer rather than the inside is not clearly elucidated, but is considered due to the fact that the oxide in the outermost surface layer moves toward through the internal oxidation and moves into the scale or easily removed together with the scale in the pickling, and the like.

And also, it is considered that the solid solution degree of the easily-oxidizable metallic element is lowered by such a mechanism to render the outermost surface layer into an iron layer having less solid solution element.

Then, an alloyed galvanized hot rolled steel sheet is produced by pickling the thus obtained hot rolled steel sheet and subjecting to an alloying treatment by heating through heating→galvanization→salt bath by means of a vertical type hot dipping simulation device made by RESUKA Co., Ltd.

In FIG. 4 are shown results measured on the state of forming bare spot in the hot dipping. Moreover, the evaluation of bare spot is carried out by measuring an area of bare spot through an image processing.

As seen from this figure, it has been confirmed that there is no formation of bare spot when the hot rolled steel sheet adhered with the black skin scale is heat-treated in a substantially non-reducing atmosphere (A).

Moreover, the chemical composition is not particularly limited as a starting steel sheet for the above hot rolled steel sheet. All of the conventionally known sheets such as so-called low carbon steel sheets, extremely-low carbon steel sheets, Mn-added high-strength steel sheets, Si-Mn-added high-strength steel sheets and the like are adapted.

Particularly, Mn based high-strength steel sheets added with a relatively large amount of Mn for increasing strength and high Si-Mn based high-strength steel sheets added with Si and Mn are preferable.

In this case, Mn is favorable to be included in an amount of not less than 0.2 mass % for increasing the strength. However, when it is included in an amount exceeding 3.0 mass %, a practical high-tension material is not obtained, so that the Mn amount is favorable to be about 0.2–3.0 mass %.

And also, Si does not induce the degradation of the hot-dipping property requiring the method according to the invention when the amount is less than 0.1 mass %, while when it exceeds 2.0 mass %, the degradation of the hot-dipping property can not be avoided even if the method according to the invention is adopted, so that it is favorable that Si is included within a range of 0.1–2.0 mass %, if necessary.

Further, Ti, Nb, B, Mo, Sb, P, C, N, Cu, Ni, Cr, V, Zr and the like may properly be included, if necessary.

Next, the invention will be described with respect to a cold rolled steel sheet as a target of the steel sheet.

Even in the cold rolled steel sheet, the procedure up to the completion of the hot rolling is the same as in the case of the hot rolled steel sheet, wherein the heat treatment of the hot rolled steel sheet is carried out in an atmosphere substantially not causing reduction while being adhered with the black skin scale to form an internal oxide layer in the surface layer portion of the iron matrix in the steel sheet.

Then, the thus obtained hot rolled steel sheet is pickled, cold-rolled and subjected to recrystallization annealing to obtain a cold rolled steel sheet. And also, it is subjected to a hot dipping treatment and further to an alloying hot dipping treatment.

Now, an Si—Mn hot rolled steel sheet containing Si: 0.5 mass % and Mn: 1.5 mass % is subjected to a heat treatment under various conditions to obtain four heat-treated materials, i.e. A: heat-treated material of black skin hot rolled steel sheet (100 vol % $N_2$, 750° C., 5 hours), B: heat-treated material of black skin hot rolled steel sheet (5 vol % $H_2$—$N_2$, 750° C., 5 hours), C: heat-treated material of black skin hot rolled steel sheet (100 vol % $H_2$, 750° C., 5 hours) and D: heat-treated material of white skin hot rolled steel sheet (100 vol % $N_2$, 750° C., 5 hours), which are subjected to pickling—cold rolling and then to an alloying treatment by heating through recrystallization annealing→galvanization→salt bath by means of a vertical type hot dipping simulation device made by RESUKA Co., Ltd. to produce alloyed galvanized steel sheets.

In FIG. 5 are shown surface enriched states of Si, Mn after the above heat treatment for hot rolled steel sheet, and results measured on the state of forming non-dipped portion in the hot dipping are shown in FIG. 6.

The surface enriched amounts of Si, Mn are measured by analysis of polar surface through GDS (Grimm-Grow's spectral analysis) and evaluated as 10 second integrated intensity of Si, Mn. And also, the evaluation of bare spot is carried out by measuring an area of bare spot through an image processing.

As seen from FIGS. 5 and 6, the surface enrichment of Si, Mn is smallest when the black skin scale is at an adhered state and the heat treating atmosphere for hot rolled steel sheet is substantially non-reducing, and it has been confirmed that there is caused no formation of bare spot.

Moreover, the enriched state of Si or Mn can be detected by measuring elementary distribution in a depth direction from the surface dipped layer to the inside of the iron matrix through GDS (Grimm-Grow's spectral analysis).

For this end, the enriched state of Si or Mn after the hot dipping treatment is examined by using GDS with respect to the galvanized steel sheet and the alloyed galvanized steel sheet.

In FIGS. 7(*a*), (*b*) are shown comparative results measured on the conventional material and the invention material for the galvanized Si—Mn steel sheet containing 0.5 mass % Si-1.5 mass % Mn, and comparative results of the steel materials measured after the alloying treatment are shown in FIGS. 8(*a*), (*b*), respectively.

In the conventional material, the hot rolled steel sheet is not subjected to the heat treatment, while in the invention material, the hot rolled steel sheet adhered with the black skin is subjected to the heat treatment in nitrogen atmosphere at 750° C. for 10 hours and pickled and cold-rolled and then subjected to a galvanizing treatment and an alloying treatment in a continuous hot dipping installation.

As shown in FIGS. 7 and 8, the enrichment of Mn or Si is not observed in the surface layer portion of the iron matrix in the conventional material, while the enrichment of Mn or Si is observed in the surface layer portion of the iron matrix in the invention material.

This is due to the fact that surrounding Mn or Si is concentrated as an oxide, and hence solid solution concentrations of metallic Mn and metallic Si in the neighborhood becomes lower. And also, such an enrichment is not created in an interface between the hot-dipped layer and the iron matrix, but is created in the surface layer portion of the iron matrix just beneath the hot-dipped layer.

Moreover, the interface between the iron matrix and the hot-dipped layer can be judged by ½ position of Zn intensity in the hot-dipped layer and a half position between Fe intensity of the iron matrix and Fe intensity in the hot-dipped layer.

Particularly, the alloyed galvanized steel sheet is produced by a heating diffusion treatment, so that the enriched layer is diffused more toward the side of the iron matrix as compared with the galvanized steel sheet.

And also, a region lowering the Mn concentration is observed in such Mn enriched layer toward the inside of the iron matrix, and a region deeper than the above region is a steady state reflecting the composition of the iron matrix.

When elements oxidizable more easily than Fe such as Si, B, P and the like are added to steel, the enrichment of these elements is generally observed in the surface layer portion of the iron matrix. Particularly, Si and B are strongly oxidized elements, so that their enrichment is easily observed in the surface layer portion of the iron matrix.

When the enrichment of an oxide of Mn or the like is observed in the surface layer portion of the iron matrix as mentioned above, solid solution metallic element such as Mn or the like is exhausted in the outermost surface of the iron matrix and hence the hot-dipping property is improved.

As the internal oxide layer in the surface layer portion of the iron matrix is particularly evaluated by peak intensity ratios of Mn/Fe and Si/Fe of GDS, when these values are not less than 1.01 times peak intensity ratios of Mn/Fe and Si/Fe in the inside of the iron matrix, the considerably excellent hot-dipping property is obtained.

Moreover, the chemical composition is not limited even in the above cold rolled steel sheet, so that any of the conventionally known ones are adaptable likewise the aforementioned hot rolled steel sheets.

Then, the invention will be described with respect to cold rolled steel sheet particularly having an excellent workability among the above cold rolled steel sheets.

This is fundamentally the same as in the aforementioned general cold rolled steel sheets, but in order to improve the workability, it is required to restrict the chemical composition to given ranges.

Now, black skin hot rolled steel sheet and white skin hot rolled steel sheet are prepared by using 0.002 mass % C-0.5 mass % Si-1.5 mass % Mn-0.10 mass % P-0.05 mass % Ti-23 mass ppm B steel as a starting material and heat treating under conditions of 750° C. and 5 hours, and then sections thereof after the heat treatment for hot rolled steel sheet are observed by an optical microscope.

The results are the same as shown in FIG. 1, wherein the formation of the internal oxide layer is observed in the surface layer portion of the iron matrix in case of the black skin hot rolled steel sheet, while the formation of the internal oxide layer is not observed in case of the white skin hot rolled steel sheet.

In FIG. 9 are shown results observing the state of the internal oxide layer formed in the surface layer portion of the iron matrix with respect to hot rolled steel sheet after the hot rolled steel sheet having the same chemical composition as mentioned above is heat-treated (800° C., 10 hours) while being adhered with the black skin scale, steel sheet after the subsequent cold rolling and steel sheet after recrystallization annealing (880° C., 40 seconds) of the cold rolled steel sheet.

As seen from this figure, when the internal oxide layer is formed in the surface layer portion of the iron matrix by subjecting the black skin hot rolled steel sheet to the heat treatment, it uniformly remains in the surface layer portion of the iron matrix even after the subsequent cold rolling or further after the recrystallization annealing.

Next, an alloyed galvanized steel sheet is produced by subjecting the aforementioned hot rolled steel sheet to pickling—cold rolling and then conducting an alloying treatment by heating (470° C.) through recrystallization annealing→galvanization→salt bath by means of a vertical type hot dipping simulation device made by RESUKA Co., Ltd. Moreover, steel used as a starting material is 0.002 mass % C-0.5 mass % Si-1.5 mass % Mn-0.10 mass % P-0.05 mass % Ti-23 mass ppm B steel, and the heat treating conditions of the hot rolled steel sheet are 750° C. and 5 hours, and the recrystallization annealing conditions are 850° C., 30 seconds, dew point: −30° C. and 5 vol % $H_2$—$N_2$ atmosphere.

In FIG. 10 are shown surface enriched states of Si, Mn after the above heat treatment for hot rolled steel sheets, and results measured on the state of forming bare spot in the hot dipping are shown in FIG. 11.

As seen from FIGS. 10 and 11, the surface enrichment of Si, Mn is smallest when the black skin scale is at an adhered state and the heat treating atmosphere of the hot rolled steel sheet is substantially non-reducing, and it has been confirmed that there is caused no formation of bare spot.

In FIGS. 12 and 13 are shown appearance and powdering property after the alloying treatment with respect to the black skin hot rolled steel sheet and the white skin hot rolled steel sheet.

Moreover, the appearance after the alloying treatment is evaluated by ○: even baking (uniform), Δ: uneven baking and ×: no alloying.

As seen from these figures, the delay of the alloying is solved in case of the black skin hot rolled steel sheet, and an excellent appearance is obtained as compared with the white skin hot rolled steel sheet. And also, the good powdering property is obtained even when the Fe content is about 10 wt % (good: not more than 3000 cps).

In the cold rolled steel sheet having an excellent workability, it is required to limit the chemical composition to the following range. C: 0.0005–0.005 mass %

It is desirable to decrease C amount from a viewpoint of the improvement of elongation, but when it is less than 0.0005 mass %, the degradation of resistance to secondary working brittleness and the lowering of strength in a weld zone (heat affected zone) are caused and the decrease to less than 0.0005 mass % is inconvenient industrially and costly. On the other hand, when the C amount exceeds 0.005 mass %, even if equal amounts of Ti, Nb are added, the remarkable effect of improving the properties (particularly, ductility) is not obtained and also there is feared inconveniences at steel-making step, hot rolling step and other production steps. Therefore, the C amount is limited to a range of 0.0005–0.005 mass %. Si: not more than 1.5 mass %

It is basically sufficient to adjust Si amount in accordance with a target level of tensile strength, but when it exceeds 1.5 mass %, the hot rolled base sheet is remarkably cured to degrade the cold rolling property, and further conversion treating property and hot-dipping property are degraded, and also the alloying is delayed in the alloying treatment to cause a problem that the plating adhesion property is degraded. Further, it undesirably tends to increase various internal defects.

Even if the internal oxide layer is formed by subjecting the black skin hot rolled steel sheet to a heat treatment in a non-reducing atmosphere according to the invention, when the Si amount exceeds 1.5 mass %, the degradation of the conversion treating property and hot-dipping property is not avoided.

Therefore, the upper limit of the Si amount is 1.5 mass %. Moreover, Si is not necessarily an essential component, but it is favorable to be included in an amount of not less than 0.1 mass % for obtaining high r-value and high strength.

Mn: not more than 2.5 mass %

When Mn is added alone, mechanical properties after the cold rolling and annealing, particularly r-value are degraded, but when it is used together with the other components and added in an amount of not more than 2.5 mass %, the strength can be increased without causing remarkable degradation of the properties. And also, when the Mn amount exceeds 2.5 mass %, even if the internal oxide layer is formed according to the invention, the formation of bare spot in the hot dipping and the degradation of the conversion treating property can not completely be prevented.

Therefore, the Mn amount is limited to not more than 2.5 mass %. Moreover, it is favorable to be included in an amount of at least 0.2 mass % for obtaining high strength.

Al: not more than 0.1 mass %

Al is effective for cleaning steel, but it is guessed that when the removal of inclusion is sufficient, even if no Al is substantially added, there is caused no degradation of the properties. However, when it exceeds 0.1 mass %, the degradation of the surface quality is caused, so that the Al amount is limited to 0.1 mass %. Moreover, it is favorable to be included in an amount at least 0.01 mass % for cleaning steel.

P: not more than 0.10 mass %

The addition of P can improve the workability while increasing the strength. This effect becomes remarkable in an amount of not less than 0.04 mass %. However, when it exceeds 0.10 mass %, segregation in the solidification becomes remarkable and hence the degradation of the workability is caused and further the resistance to secondary working brittleness is largely degraded and is not substantially durable in use. And also, the addition of large amount of P delays the alloying rate after the hot dipping to degrade the plating adhesion property, so that there is disadvantageously caused a problem of peeling the dipped layer (powdering) in the working.

Therefore, the upper limit of the P amount is 0.10 mass %. Moreover, P is not necessarily an essential component, but the excessive decrease is inconvenient costly, so that it is desirable to be included in an amount of not less than 0.005 mass %, preferably not less than 0.04 mass %.

S: not more than 0.02 mass %

The decrease of S amount is advantageous in a point that precipitates in steel are decreased to improve the workability and also effective Ti amount fixing C is increased. Further, it is desirable to decrease S amount as far as possible from a viewpoint of the alloying delay. From these points, the S amount is limited to not more than 0.02 mass %.

Moreover, the excessive decrease is costly inconvenient, so that the lower limit is favorable to be about 0.005 mass %.

N: not more than 0.005 mass %

As N amount becomes less, the improvement of the properties (particularly, ductility) can be expected, and the satisfactory effect is substantially obtained when it is particularly not more than 0.005 mass %. Therefore, the N amount is limited to not more than 0.005 mass %.

However, the excessive decrease is costly inconvenient, so that the lower limit is favorable to be about 0.0010 mass %.

Ti: 0.010–0.100 mass %

Ti is a carbonitride forming element and acts to decrease solid solution C, N. in steel before finish hot rolling and cold rolling to preferentially form {111} orientation in the annealing after the finish hot rolling and the cold rolling, so that it is added for improving the workability (deep drawability). However, when the addition amount is less than 0.010 mass %, the addition effect is poor, while when it exceeds 0.100 mass %, the effect is saturated and the surface quality is rather degraded, so that the Ti amount is limited to a range of 0.010–0.100 mass %.

Nb: 0.001–0.100.mass %

Nb is also a carbonitride forming element and acts to decrease solid solution C, N in steel before finish hot rolling and cold rolling likewise Ti and make the structure before the finish hot rolling fine to preferentially form {111} orientation in the finish hot rolling and the annealing. And also, solid soluted Nb has an effect of storing strain in the finish hot rolling to promote the development of the texture. However, when the amount is less than 0.001 mass %, the above effect is poor, while when it exceeds 0.100 mass %, the improvement of the effect is not desired and the rise of the recrystallization temperature is rather caused, so that the Nb amount is limited to a range of 0.001–0.100 mass %.

Moreover, in the invention, it is sufficient to include at least either one of Ti and Nb.

Although the invention is described with respect to the essential components, the following elements may be further included in the steel sheet.

B: not more than 0.005 mass %

B effectively contributes to improve the resistance to secondary working brittleness, but the effect is saturated when the amount exceeds 0.005 mass % and there is rather feared the degradation of the workability in accordance with the annealing conditions. And also, the hot rolled steel sheet is considerably hardened. Therefore, the upper limit of the B amount is 0.005 mass %. Moreover, the lower limit is not particularly restricted and the required amount may be used in accordance with the degree of improving the resistance to secondary working brittleness, but it is favorable to be not less than 0.0005 mass %, preferably not less than 0.0015 mass %.

Mo: 0.01–1.5 mass %

Mo has an action of strengthening steel without obstructing the hot-dipping property, so that it may properly be included in accordance with the desired strength. However, when the amount is less than 0.01 mass %, the addition effect is poor, while when it exceeds 1.5 mass %, it tends to badly affect the workability and is unfavorable in economical reasons, so that Mo is included in an amount of 0.01–1.5 mass %.

Cu: 0.1–1.5 mass %

Cu has an action of strengthening steel and may be included in accordance with the desired strength because the hot-dipping property and conversion treating property are not substantially obstructed by the addition of Cu. However, when the amount is less than 0.1 mass %, the addition effect is poor, while when it exceeds 1.5 mass %, it badly affects the workability, so that the Cu amount is limited to a range of 0.1–1.5 mass %.

Ni: 0.1–1.5 mass %

Ni has an action of strengthening steel but also advantageously contributes to improve the surface quality of the steel sheet containing Cu. And also, the hot-dipping property and conversion treating property are not substantially obstructed by the addition of Ni, so that it may properly be included in accordance with the desired strength. However, when the amount is less than 0.1 mass %, the addition effect is poor, while when it exceeds 1.5 mass %, it badly affects the workability, so that the Ni amount is limited to a range of 0.1–1.5 mass %.

Besides, Cr, Sb, V, REM, Zr or the like may be included in an amount of not more than 0.1 mass % inevitably or if necessary.

Each production method of the steel sheet, hot-dipped steel sheet and alloyed hot-dipped steel sheet according to the invention will be described below.

Firstly, the invention is described with respect to the production method of the hot rolled steel sheet as well as the hot-dipped steel sheet and the alloyed hot-dipped steel sheet using the same as a starting material.

As a method of producing steel sheet, a continuous casting method is advantageously adaptable, but an ingot making-blooming method may be used undoubtedly.

The hot rolling is not particularly restricted and is sufficient to be conducted by the conventionally known method.

Typical hot rolling conditions are rolling reduction: 80–99%, hot rolling finish temperature: 600–950° C. and coiling temperature: 300–750° C.

The sheet thickness is usually about 1.6–6.0 mm in case of the hot rolled steel sheet, but a thin sheet of about 0.8 mm is adaptable with the advance of strong reduction technique in the recent hot rolling.

In general, the thus obtained hot rolled steel sheet is supplied as a product after it is pickled to remove black skin scale, or subjected to a hot dipping to provide a hot-dipped hot rolled steel sheet. In the invention, however, the hot rolled steel sheet adhered with the black skin scale after the hot rolling is subjected to a heat treatment in an atmosphere substantially not causing reduction to form an internal oxide layer in a surface layer portion of iron matrix in the steel sheet and also render an outermost surface layer of the iron matrix into an iron layer largely decreasing a solid solution amount of an easily-oxidizable metallic element (purified iron layer: depression layer), whereby it is attempted to stably improve the hot-dipping property and conversion treating property.

In the invention, the iron layer decreasing the solid solution amount of easily-oxidizable metallic element does not mean 100% iron containing no other element, but means that the solid solution concentration of the easily-oxidizable metallic element such as Si, Mn or the like is considerably decreased as compared with the inside of the iron matrix to increase iron concentration.

Moreover, the metallic state and the oxide state can not be distinguished by elementary analysis, but it can be confirmed in typical cases that the iron layer decreasing the solid solution amount of the easily-oxidizable metallic element is existent at the side of the surface layer rather than the internal oxide through GDS as shown in FIG. 3. Since there is a case that it is difficult to directly confirm such an iron layer, the existence of the iron layer decreasing the solid solution amount of the easily-oxidizable metallic element in the surface layer can be confirmed by simply confirming the internal oxide layer through an observation of an optical microscope. Because, the solid solution degree of the easily-oxidizable metallic element in the outermost surface layer is decreased by the formation of the internal oxide layer.

In order to stably obtain the excellent hot-dipping property, it is desirable that a thickness of the internal oxide layer is about 5–40 $\mu$m and an area ratio of the internal oxide layer in the surface layer is about 1–20%.

Moreover, the latter value can easily be judged as an area ratio of blackish portion in the no-etched sectional observation (1000 magnification).

In the above heat treating step of the hot rolled steel sheet, the treating temperature is required to be 650–950° C. When the heat treating temperature exceeds 950° C., crystal grain size is coarsened to cause rough skin, while when the heat treating temperature lower than 650° C., the iron layer decreasing the solid solution amount of the easily-oxidizable metallic element can not sufficiently be formed. And also, in case of producing the cold rolled steel sheet as mentioned later, when the heat treating temperature of the hot rolled steel sheet exceeds 950° C., there are caused disadvantages that the surface is roughened in the subsequent cold rolling accompanied with the coarsening of the crystal grain size and the strain in the cold rolling is made ununiform to bring about the lowering of r-value.

Moreover, the heat treating time is not particularly restricted, but it is favorable to be about 4–40 hours.

In the invention, 100 vol % $N_2$ atmosphere is best as an atmosphere substantially not causing reduction, and $H_2$—$N_2$ mixed atmosphere containing less than 5 vol % of $H_2$ content is advantageously adaptable.

When the $H_2$ content is not less than 5 vol %, the formation of the internal oxide layer is considerably less and hence the iron layer decreasing the solid solution amount of the easily-oxidizable metallic element is hardly formed in the outermost surface layer, but also reduced iron containing a metal oxide is formed on the surface of the black skin scale, which undesirably obstruct the removal of the remaining scale at the pickling step.

And also, an oxidizing atmosphere containing a large amount of oxygen such as air or the like is unsuitable because oxidation of the easily-oxidizable metallic element in steel or iron itself proceeds on the surface of the iron matrix and the formation of the internal oxide layer is considerably less and the iron layer decreasing the solid solution amount of the easily-oxidizable metallic element is not formed on the outermost surface layer. However, if $O_2$ amount in 100 vol % $N_2$ atmosphere or $H_2$—$N_2$ mixed atmosphere containing less than 5 vol % of $H_2$ amount is not more than 1 vol %, the oxidation of iron is small to a level causing no problem and the internal oxide layer is formed to decrease the solid solution degree of the easily-oxidizable metallic element in the outermost surface layer, so that oxygen may be included up to the above value. The complete elimination of $O_2$ is large in the economical disadvantage.

Then, it is subjected to pickling.

The pickling condition is not particularly restricted. The pickling may be carried out with hydrochloric acid or sulfuric acid according to usual manner by adding a pickling accelerator or a pickling inhibitor, if necessary, but it is desirable to conduct no extreme pickling excessively removing the iron matrix of not less than several $\mu$m.

In case of the subsequent hot dipping, the heating is carried out to reduce oxide covering the surface (invisible oxide) or promote the activation of the surface. The heating condition is not particularly restricted. The heating may be carried out according to usual manner in, for example, an atmosphere of $H_2$: 2–20 vol % and the remainder: $N_2$ under conditions of dew point: −50° C.–+10° C., temperature: 500–950° C. and time: about 10 seconds-10 minutes.

By conducting such a heating are swept off Fe oxide on the surface of the iron matrix, oxide of P or the like and composite oxide with iron from the surface, whereby the excellent hot-dipping property and alloying property are obtained.

And also, even when radiation type heating of radiant tube or the like is used in the heating before the hot dipping, the outermost surface layer is rendered into the iron layer decreasing the solid solution amount of the easily-oxidizable metallic element, so that the invention has a merit capable of ensuring the excellent hot-dipping property and alloying property.

Furthermore, according to the invention, skin-pass rolling of not more than 10% can be applied to a steel sheet after the hot dipping treatment as mentioned later for shape correction and adjustment of surface roughness or the like.

The hot dipping applied to the thus obtained hot rolled steel sheet may be conducted by the conventionally known method.

For example, in case of a galvanizing treatment, the heated steel sheet is immersed in a galvanizing bath at a bath temperature of about 460–490° C. to conduct the hot dipping. In this case, a sheet temperature in the immersion into the bath is preferable to be about 460–500° C. And also, in case of the galvanization or alloyed galvanization, Al amount in the galvanizing bath is favorable to be about 0.13–0.5 mass %.

The hot rolled steel sheet immersed in the galvanizing bath is pulled out from the bath and then a coating weight thereof is adjusted by a gas wiping treatment or the like to obtain a galvanized hot rolled steel sheet.

Further, such a galvanized hot rolled steel sheet can be rendered into an alloyed galvanized hot rolled steel sheet by subjecting to subsequent alloying treatment by heating.

In this case, the alloying conditions by heating are favorable to be 460–520° C. and about 0.1–1.0 minute.

Moreover, as the other hot dipping treatment, there are hot dip aluminizing, zinc-aluminum hot dipping, zinc-magnesium-aluminum hot dipping and the like. These hot dipping treatments may be carried out according to the conventionally known method. And also, there is a case that a small amount of Pb, Sb, Bi, REM, Ti or the like may be added to the dipping bath.

Further, the coating weight by the hot dipping is favorable to be about 20–100 g/m$^2$ per one-side surface in an automobile application. On the other hand, it is favorable to be about 100–400 g/m$^2$ in applications of building materials and earth-moving.

Next, the invention is described with respect to the production method of the cold rolled steel sheet as well as the hot-dipped steel sheet and the alloyed hot-dipped steel sheet using the same as a starting material.

The production steps up to the hot rolled steel sheet and the heat treating conditions for hot rolled steel sheet are the same as in the above hot rolled steel sheet.

In case of the cold rolled steel sheet, the hot rolled steel sheet after the heat treatment is subjected to pickling and cold rolling.

The cold rolling condition is not particularly restricted and is sufficient according to the usual manner, but the rolling reduction is favorable to be about 50–95% in order to advantageously develop {111} texture.

Thereafter, it is subjected to a recrystallization annealing. The recrystallization annealing condition is not particularly restricted, but is favorable to be 600–950° C. and about 0.5–10 minutes according to the usual manner.

Then, it is subjected to a hot dipping treatment, further an alloying hot dipping treatment or further skin-pass rolling. These treatments are sufficient to be carried out under the same conditions as in the above hot rolled steel sheet.

Next, the invention is described with respect to the production method of the cold rolled steel sheet having an excellent workability as well as the hot-dipped steel sheet and the alloyed hot-dipped steel sheet using the same as a starting material.

This case is fundamentally common as the cases of the hot rolled steel sheet and usual cold rolled steel sheet, but it is required to strictly control the production conditions in order to ensure the properties.

That is, in order to increase average of r-value in the cold rolled steel sheet, it is favorable to develop {111} orientation in the texture after the hot rolling and annealing. For this purpose, it is necessary that the texture is made fine and uniform in the hot rolling and before the finish rolling and subsequently a large amount of strain is uniformly stored on the steel sheet in the finish rolling to preferentially form {111} orientation in the annealing.

In order to make the texture before the hot finish rolling fine and uniform, it is favorable to finish the hot rough rolling just on Ar3 transformation point to form $\gamma \rightarrow \alpha$ transformation before the finish rolling. Therefore, the finish temperature of the hot rough rolling is required to be not lower than $Ar_3$ transformation point. However, when the finish temperature of the rough rolling exceeds 950° C., recovery or grain growth is caused in the course of cooling up to $Ar_3$ transformation point producing $\gamma \rightarrow \alpha$ transformation to make the texture before the finish rolling coarse and ununiform. Therefore, the finish temperature of the rough rolling is limited to a range of not lower than $Ar_3$ transformation point but not higher than 950° C.

Moreover, the rolling reduction in the hot rough rolling is desirable to be not less than 50% for fining the texture.

In order to store a large amount of strain in the hot finish rolling, it is desirable that the finish rolling is carried out at a temperature of not higher than $Ar_3$ transformation point and a rolling reduction of not less than 80%. Because, when the finish rolling is carried out at a temperature of higher than $Ar_3$ transformation point, $\gamma \rightarrow \alpha$ transformation is caused in the hot rolling to release strain or make the rolled texture random and hence {111} orientation is not preferentially formed in the subsequent annealing.

And also, the finish rolling temperature of not higher than 500° C. is not actual because the rolling load considerably increases.

Further, when the total rolling reduction is less than 80%, the texture of {111} orientation is not developed after the hot rolling and annealing.

Therefore, the hot finish rolling is carried out under conditions of rolling finish temperature: not lower than 500° C. but not higher than $Ar_3$ transformation point and rolling reduction: not less than 80%.

Furthermore, in order to uniformly store a large amount of strain in the finish rolling, the finish rolling is required to be lubrication rolling. Because, when the lubrication rolling is not used, additional shearing force is applied to the surface layer portion of the steel sheet by friction force between the roll and the surface of the steel sheet to develop texture not being {111} orientation after the hot rolling and annealing and hence the average of revalue of the cold rolled steel sheet tends to lower.

Then, the thus obtained hot rolled steel sheet is subjected to a heat treatment for hot rolled steel sheet. Such a heat treatment is sufficient to be carried out at a temperature range of 650–950° C. in an atmosphere substantially not causing reduction while being adhered with a black skin scale likewise the cases of the hot rolled steel sheet and the usual cold rolled steel sheet.

Next, it is subjected to a cold rolling after the black skin scale is removed by pickling.

This cold rolling is to develop the texture to obtain a high average r-value aiming at the invention, and in this case the cold rolling reduction is inevitable to be 50–95%. Because, when the cold rolling reduction is less than 50% or exceeds 95%, good properties are not obtained.

The cold rolled steel sheet after the above cold rolling is required to be subjected to a recrystallization annealing. As the recrystallization annealing, either box annealing or continuous annealing may be used, but the heating temperature is required to be a range of not lower than recrystallization temperature (about 600° C.) but not higher than 950° C.

Then, it is subjected to a hot dipping treatment, further an alloying hot dipping treatment or further skin-pass rolling. These treatments are sufficient to be carried out under the same conditions as in the above cases of the hot rolled steel sheet and the usual cold rolled steel sheet.

BRIEF DESCRIPTION OF THE DRAWINGS

FIG. 2 is a view illustrating an influence of an atmosphere in the heat treatment of the black skin hot rolled steel sheet upon the formation of internal oxide layer (FIGS. 2(*a*), 2(*b*));

FIG. 8 is a comparative graph showing element distribution in a depth direction measured through GDS with respect to the conventional alloyed galvanized steel sheet (FIG. 8(*a*)) and the alloyed galvanized steel sheet according to the invention (FIG. 8(*b*));

BEST MODE FOR CARRYING OUT THE INVENTION

Example 1

Figure 1A:
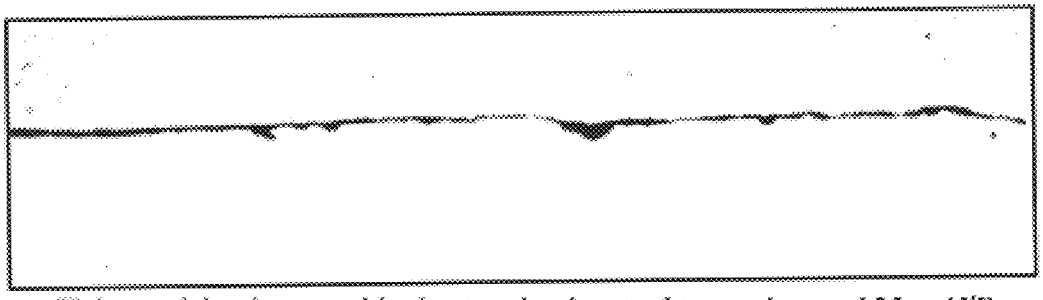
FIG. 1 is an optical microphotograph of a texture showing a section after heat treatment of white skin hot rolled steel sheet (FIG. 1(*a*)) and black skin hot rolled steel sheets (FIGS. 1(*b*), (*c*))
Figure 1B:
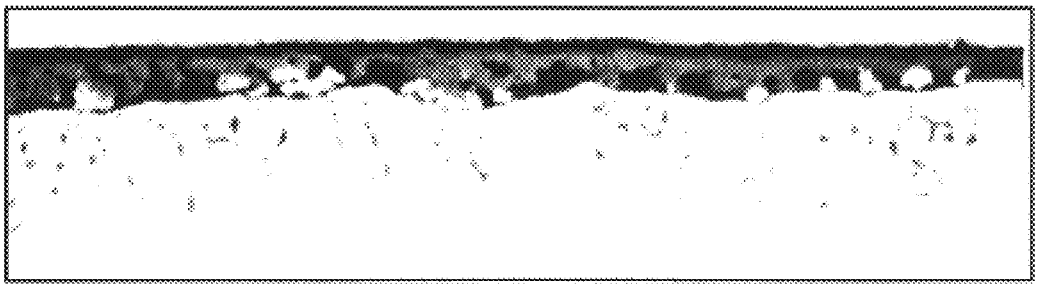
Figure 1C:
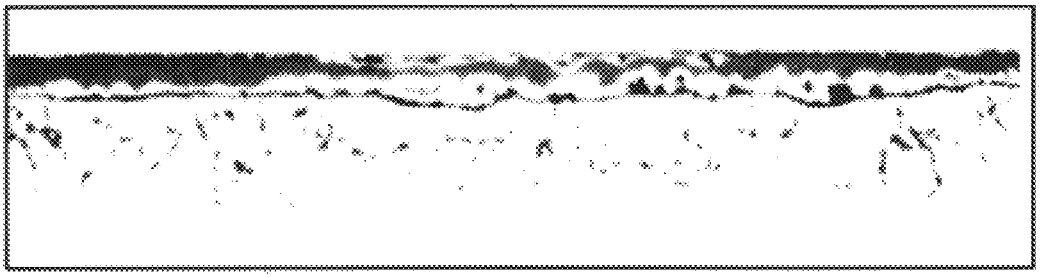
Figure 3A:
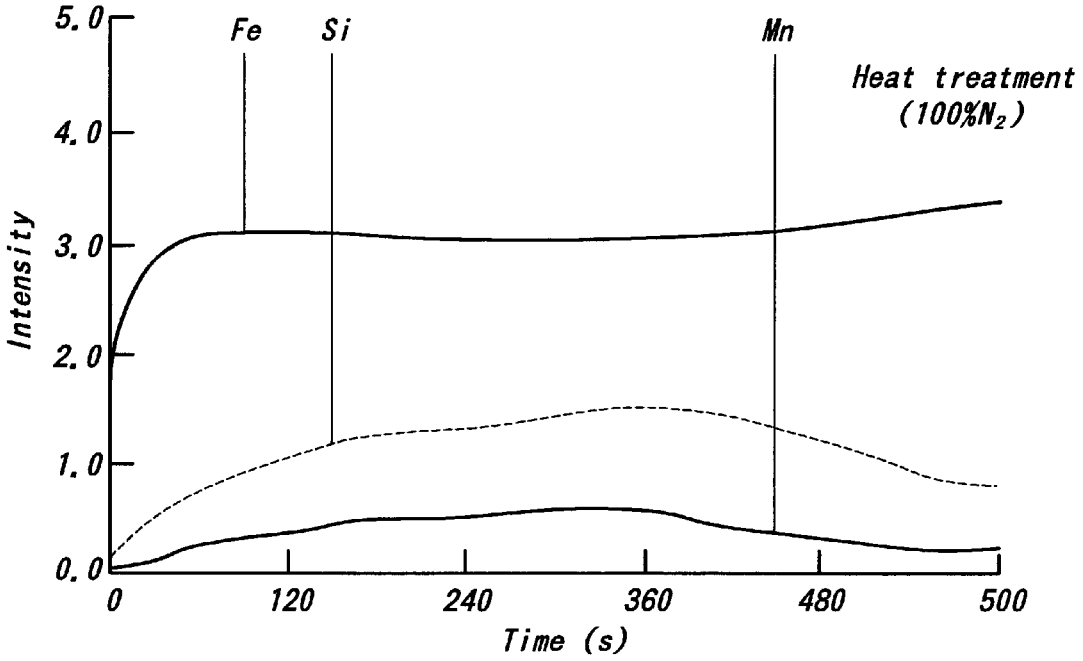
FIG. 3 is a comparative graph showing element distribution in a depth direction after the pickling with respect to (a) black skin hot rolled steel sheet subjected to a heat treatment and (b) black skin hot rolled steel sheet not subjected to a heat treatment.
Figure 3B:
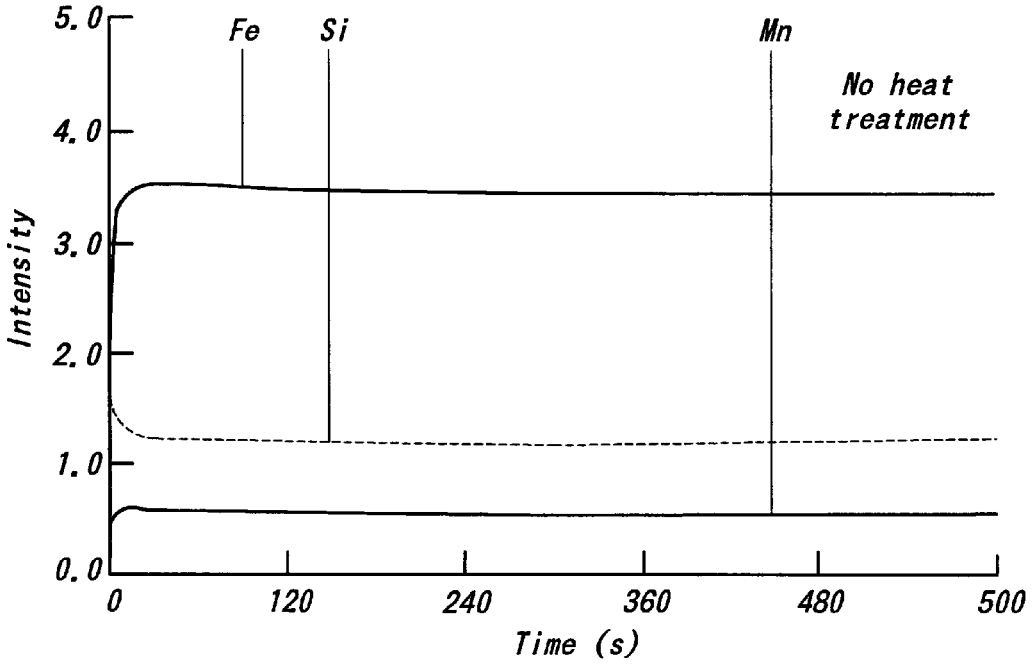
Figure 4:
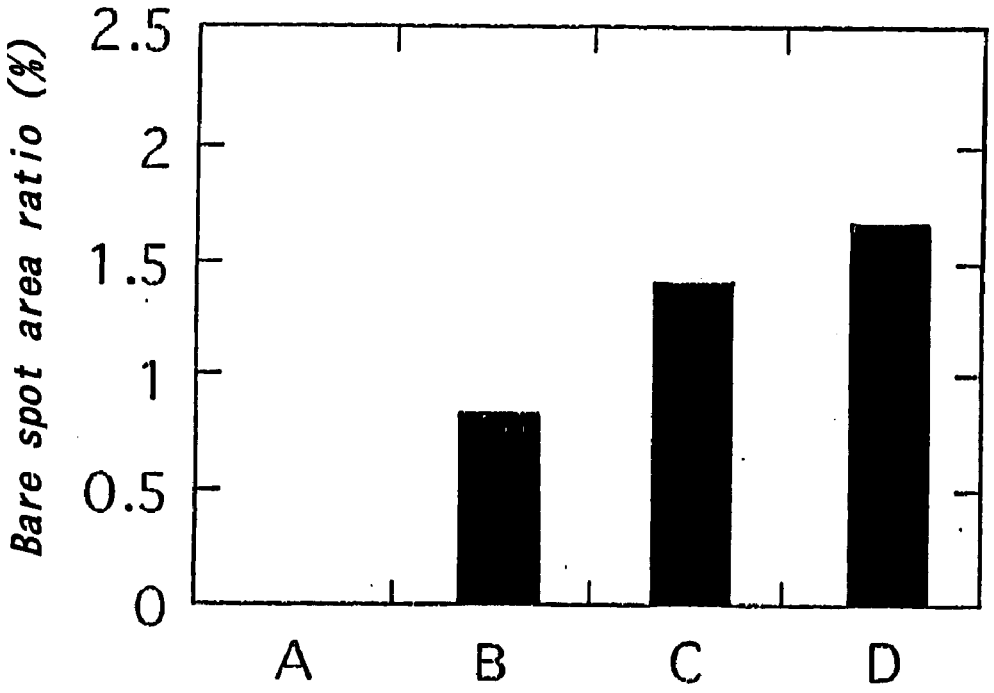
FIG. 4 is a view showing a state of making bare spot in hot dipping.
Figure 5:
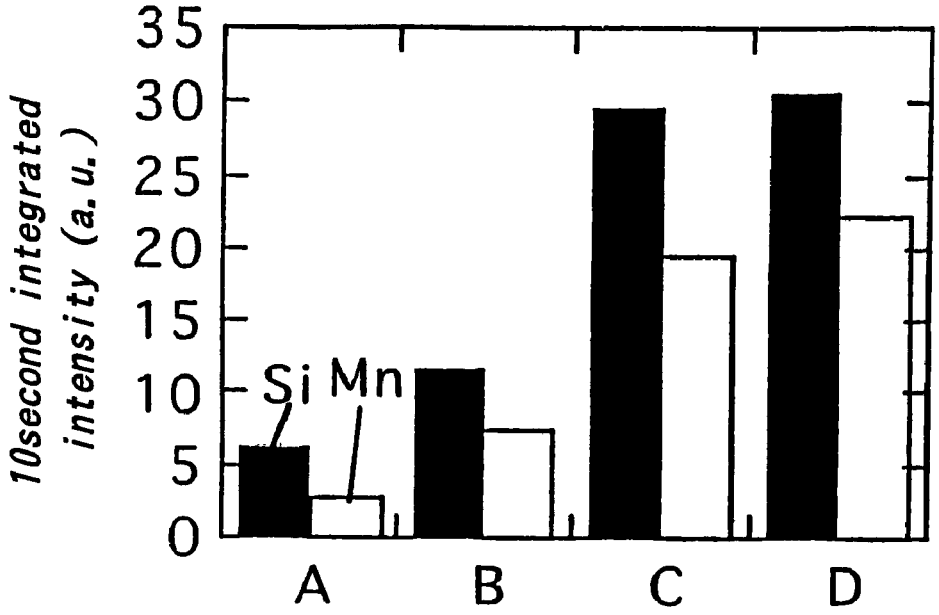
FIG. 5 is a view showing a state of surface enrichment of Si, Mn after the heat treatment of the hot rolled steel sheet.
Figure 6:
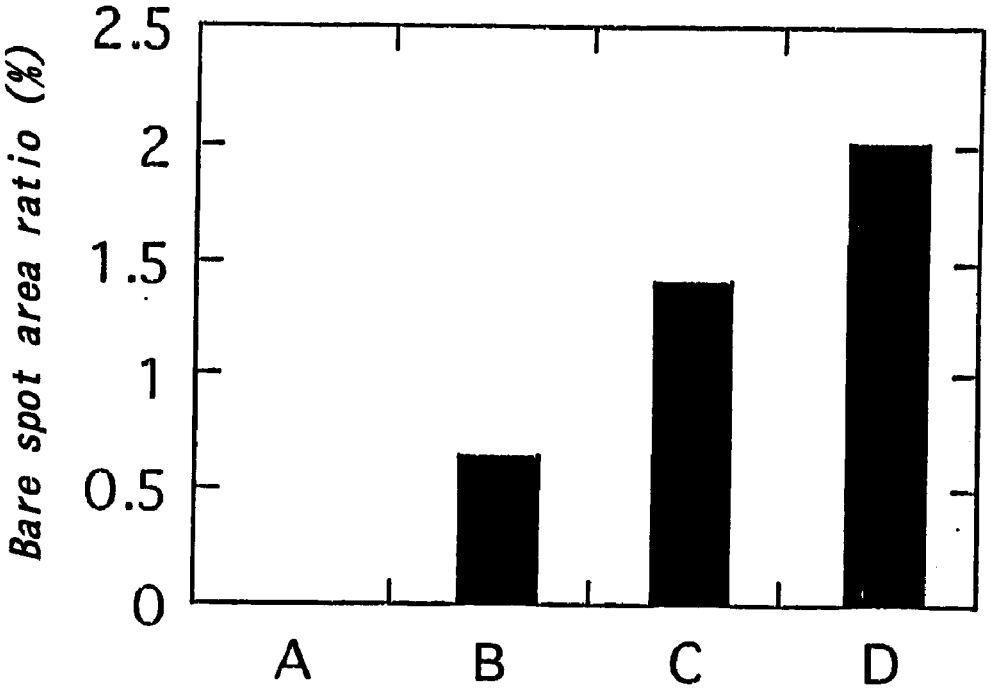
FIG. 6 is a view showing a state of making bare spot in hot dipping.
Figure 7A:
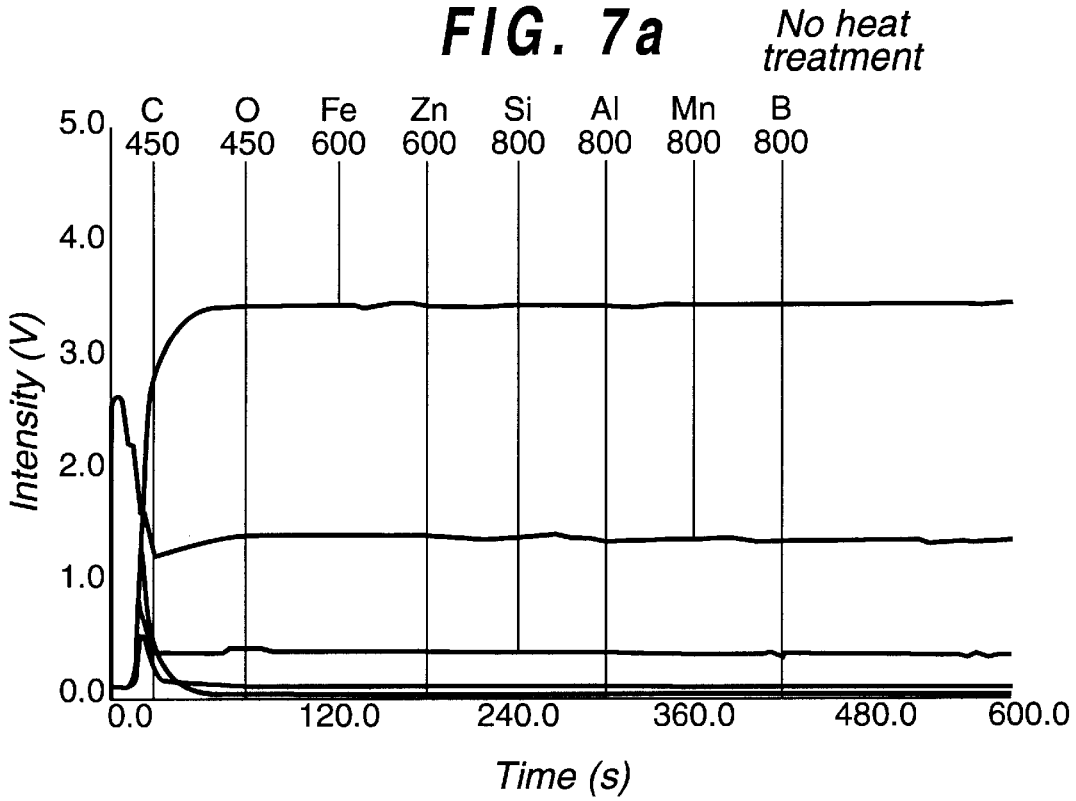
FIG. 7 is a comparative graph showing element distribution in a depth direction measured through GDS with respect to the conventional galvanized steel sheet (FIG. 7(*a*)) and the galvanized steel sheet according to the invention (FIG. 7(*b*))
Figure 7B:
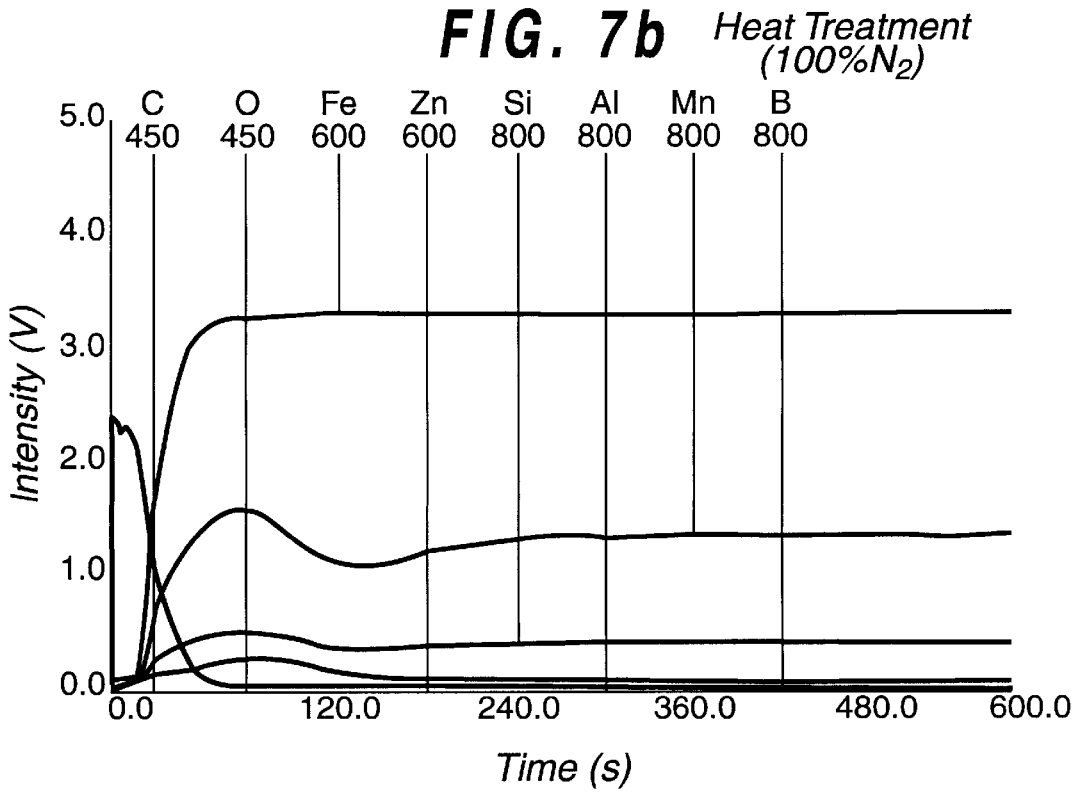
Figure 9A:
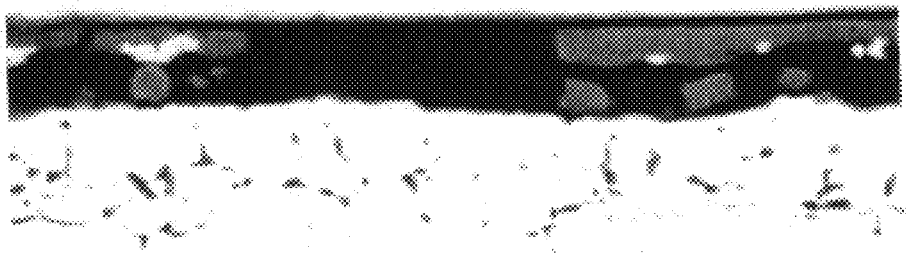
FIG. 9 is an optical microphotograph of a texture comparatively showing a state of an internal oxide layer after the heat treatment (FIG. 9(*a*)) and a state of an internal oxide layer after subsequent cold rolling (FIG. 9(*b*)) and additionally recrystallization annealing (FIG. 9(*c*))
Figure 9B:
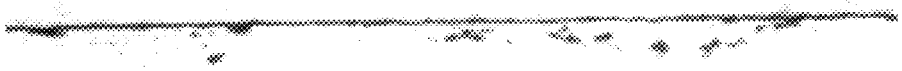
Figure 9C:
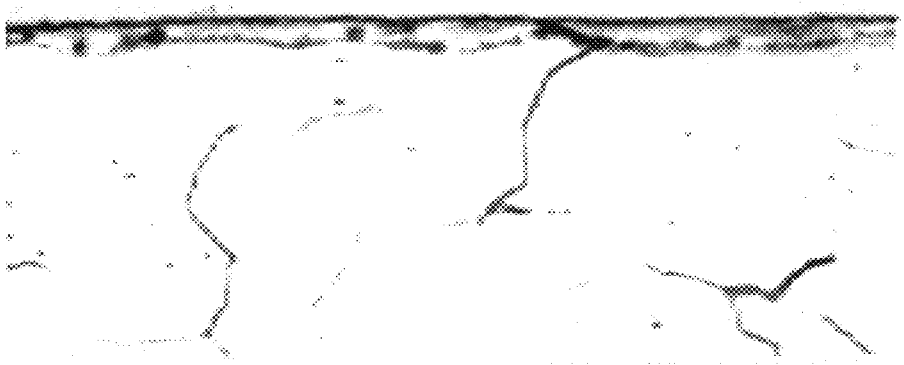
Figure 10:
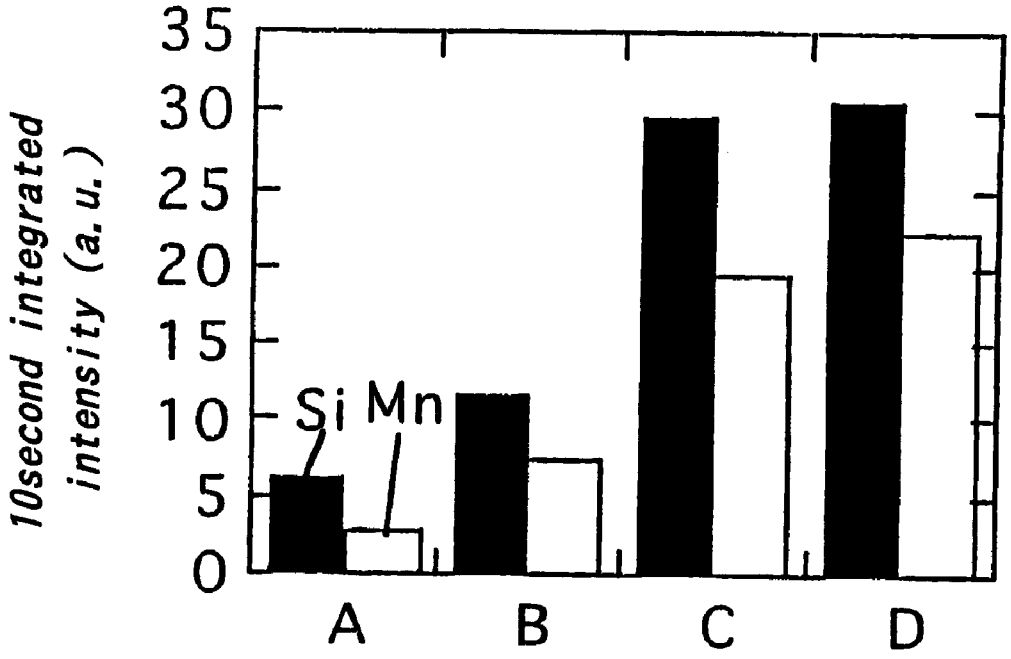
FIG. 10 is a view showing a state of surface enrichment of Si, Mn after the heat treatment of the hot rolled steel sheet.
Figure 11:
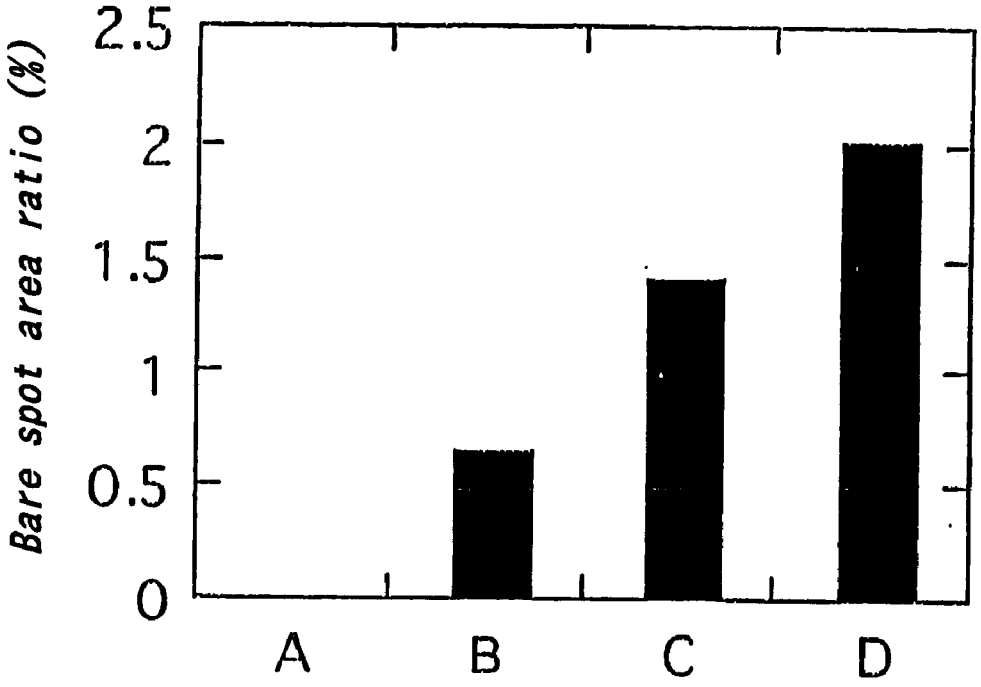
FIG. 11 is a view showing a state of making bare spot in hot dipping.
Figure 12:
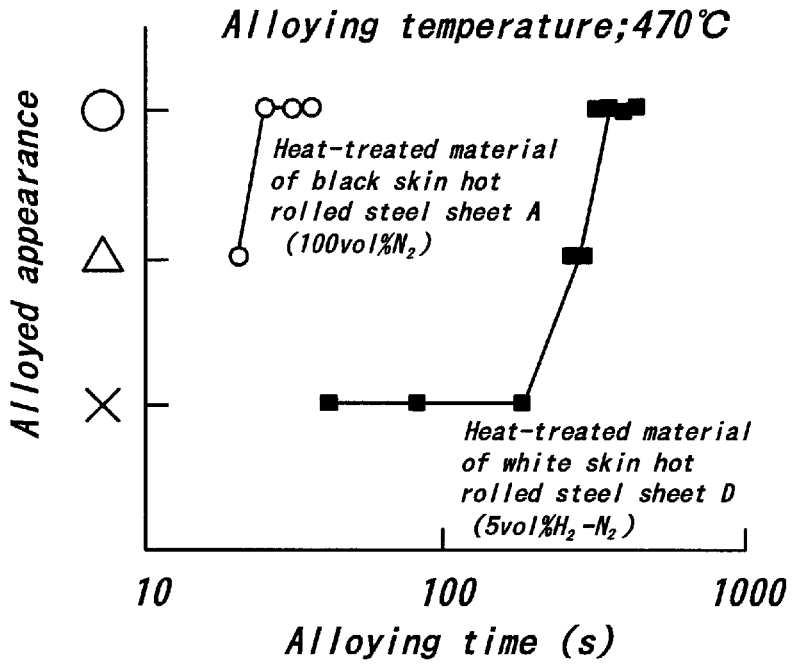
FIG. 12 is a comparative view showing an appearance after the alloying of black skin hot rolled steel sheet and white skin hot rolled steel sheet.
Figure 13:
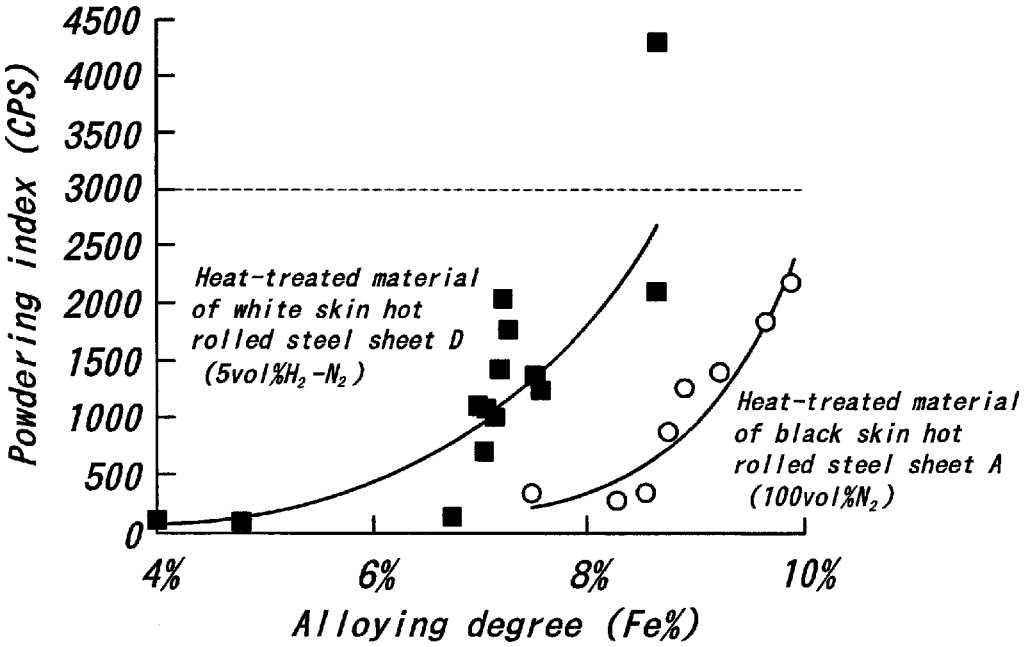
FIG. 13 is a comparative view showing a powdering property after the alloying of black skin hot rolled steel sheet and white skin hot rolled steel sheet.

A steel slab adjusted to a chemical composition shown in Table 1 is heated to 1100–1250° C. and then hot rolled to obtain a hot rolled steel sheet of 2.0 mm in thickness, which is subjected to a heat treatment for hot rolled steel sheet under conditions shown in Tables 2 and 3 and further to pickling.

The thus obtained hot rolled steel sheet is subjected to a heating treatment of 700° C. and 1 minute and further to a galvanizing treatment under conditions of bath temperature: 470° C.

sheet entry temperature: 470° C.

Al content: 0.14mass % coating weight: 60 g/m$^2$ (one-side surface)

dipping time: 1 second to produce a galvanized hot rolled steel sheet. And also, a part of the sheet is subjected to an alloying treatment to obtain an alloyed galvanized hot rolled steel sheet.

Further, a part of the sheet after the above heating treatment is subjected to a hot dip aluminizing and zinc-aluminum hot dipping.

And also, a part of the hot rolled steel sheet is subjected to a conversion treatment.

For the comparison, a hot rolled steel sheet, a hot-dipped hot rolled steel sheet and an alloyed hot-dipped hot rolled steel sheet are produced according to the conventional method.

The conversion treating property with respect to the thus obtained hot rolled steel sheets, hot-dipping property and plating adhesion property with respect to various hot-dipped hot rolled steel sheets, and alloying rate and alloyed unevenness with respect to the alloyed galvanized hot rolled steel sheets are measured to obtain results as shown in Tables 4 and 5.

The evaluation method of each property is as follows.

<Conversion Treating Property>

The steel sheet is subjected to a chemical conversion treatment of degreasing→washing with water→surface adjustment→chemical conversion shown in Table 6 to form a zinc phosphate film, which is evaluated according to the following standard.

○: The zinc phosphate film is uniformly formed over a full surface.

×: A portion not forming the zinc phosphate film is partly caused.

<Hot-dipping Property>

An appearance after the hot dipping is subjected to an image processing to measure a non-dipped area ratio, which is evaluated according to the following standard.

5: 0% of bare spot area ratio

4: not more than 0.1% of bare spot area ratio

3: more than 0.1% but not more than 0.3% of bare spot area ratio

2: more than 0.3% but not more than 0.5% of bare spot area ratio

1: more than 0.5% of bare spot area ratio

<Plating Adhesion Property>

A plating adhesion property is evaluated by a DuPont impact test (a weight having a diameter of 6.35 mm and a weight of 1 kg is dropped downward onto the steel sheet from a height of 500 mm). The judging standard is as follows.

○: no peeling of dipped film

×: peeling of dipped film

<Alloying Rate>

Alloying conditions temperature rising rate: 20° C./s temperature dropping rate: 15° C./s alloying temperature: 490° C.

alloying time: 20 seconds

The alloying rate is evaluated whether or not zinc η-phase remains on the surface of the alloyed material treated under the above conditions.

○: absence of zinc η-phase

×: presence of zinc η-phase

<Alloyed Unevenness>

The hot-dipped sheet of 100×200 mm is alloyed in a salt bath at 490° C. for 30 seconds and then the dipped appearance after the alloying is observed to evaluate the presence or absence of the alloyed unevenness.

○: absence of uneven baking (even)

×: presence of uneven baking

TABLE 1

| Steel symbol | Chemical composition (mass %) | | | | | | | | | | | | | | |
|---|---|---|---|---|---|---|---|---|---|---|---|---|---|---|---|
| | C | Si | Mn | Al | P | S | N | Ti | Nb | B | Mo | Cu | Ni | Sb | Cr |
| A | 0.0015 | — | 0.75 | 0.040 | 0.035 | 0.004 | 0.001 | — | — | — | — | — | — | — | — |
| B | 0.0017 | — | 0.73 | 0.038 | 0.038 | 0.004 | 0.001 | 0.038 | 0.012 | 0.0009 | — | — | — | 0.009 | — |
| C | 0.0023 | 0.52 | 1.51 | 0.033 | 0.070 | 0.008 | 0.002 | — | 0.035 | 0.0025 | — | — | — | 0.006 | — |
| D | 0.0031 | 1.04 | 2.12 | 0.047 | 0.090 | 0.011 | 0.003 | 0.060 | — | 0.0035 | — | — | — | — | — |
| E | 0.0013 | 0.32 | 1.10 | 0.033 | 0.007 | 0.004 | 0.002 | 0.045 | 0.009 | — | — | 0.5 | 0.3 | — | — |
| F | 0.078 | — | 2.15 | 0.038 | 0.005 | 0.007 | 0.002 | — | — | — | 0.30 | — | — | — | — |
| G | 0.075 | 1.60 | 1.70 | 0.050 | 0.010 | 0.010 | 0.003 | — | — | — | — | — | — | — | — |
| H | 0.062 | 0.70 | 1.30 | 0.030 | 0.020 | 0.0008 | 0.002 | 0.15 | — | — | — | — | — | — | — |
| I | 0.150 | 1.0 | 1.50 | 0.030 | 0.01 | 0.003 | 0.004 | — | — | — | — | — | — | — | — |
| J | 0.052 | 1.0 | 1.30 | 0.040 | 0.01 | 0.008 | 0.002 | — | — | — | — | — | — | — | 1.0 |

TABLE 2

| No. | Steel symbol | Presence or absence of black skin scale | Annealing atmosphere of hot rolled steel sheet | Annealing conditions of hot rolled steel sheet | Remarks |
|---|---|---|---|---|---|
| 1 | A | presence | 100% $N_2$ | 740° C., 12 h | Acceptable Example |
| 2 | B | " | " | " | Acceptable Example |
| 3 | C | " | " | " | Acceptable Example |
| 4 | D | " | " | " | Acceptable Example |
| 5 | E | " | " | " | Acceptable Example |
| 6 | F | " | " | 750° C., 10 h | Acceptable Example |
| 7 | G | " | " | " | Acceptable Example |
| 8 | H | " | " | 800° C., 8 h | Acceptable Example |
| 9 | I | " | " | " | Acceptable Example |
| 10 | J | " | " | " | Acceptable Example |
| 11 | A | presence | 100% $N_2$ | 970° C., 10 h | Comparative Example |
| 12 | B | " | " | 610° C., 10 h | Comparative Example |
| 13 | C | " | 100% $H_2$ | 750° C., 10 h | Comparative Example |
| 14 | D | " | 5% $H_2$ | " | Comparative Example |
| 15 | E | " | none | none | Comparative Example |
| 16 | F | absence | 100% $H_2$ | 750° C., 10 h | Comparative Example |
| 17 | G | absence | none | none | Comparative Example |
| 18 | H | " | " | " | Comparative Example |
| 19 | I | " | " | " | Comparative Example |
| 20 | J | " | " | " | Comparative Example |

TABLE 3

| No. | Steel symbol | Presence or absence of black skin scale | Annealing atmosphere of hot rolled steel | Annealing conditions of hot rolled steel sheet | Remarks |
|---|---|---|---|---|---|
| 21 | A | presence | 2% $H_2$—$N_2$ | 740° C., 12 h | Acceptable Example |
| 22 | " | " | 100% $N_2$ | 750° C., 15 h | Acceptable Example |
| 23 | " | " | 99.95% $N_2$-500 ppm $O_2$ | 800° C., 12 h | Acceptable Example |
| 24 | " | " | 100% $N_2$ | 950° C., 6 h | Acceptable Example |
| 25 | B | " | " | 650° C., 12 h | Acceptable Example |
| 26 | " | " | 2% $H_2$—$N_2$ | 700° C., 20 h | Acceptable Example |
| 27 | " | " | 100% $N_2$ | 750° C., 10 h | Acceptable Example |
| 28 | C | " | " | 850° C., 6 h | Acceptable Example |
| 29 | " | " | " | 910° C., 8 h | Acceptable Example |
| 30 | " | " | " | 700° C., 35 h | Acceptable Example |
| 31 | D | " | " | 700° C., 7 h | Acceptable Example |
| 32 | " | " | " | 800° C., 7 h | Acceptable Example*1 |
| 33 | E | " | " | 900° C., 7 h | Acceptable Example*2 |
| 34 | " | " | " | 700° C., 15 h | Acceptable Example |
| 35 | F | " | " | 750° C., 10 h | Acceptable Example*3 |
| 36 | G | " | " | 700° C., 5 h | Acceptable Example*3 |

TABLE 3-continued

| No. | Steel symbol | Presence or absence of black skin scale | Annealing atmosphere of hot rolled steel | Annealing conditions of hot rolled steel sheet | Remarks |
|---|---|---|---|---|---|
| 37 | H | " | " | 750° C., 15 h | Acceptable Example |
| 38 | I | " | " | 950° C., 7 h | Acceptable Example |
| 39 | J | " | 2% $H_2$—$N_2$ | 750° C., 15 h | Acceptable Example |
| 40 | J | " | 100% $N_2$ | 800° C., 13 h | Acceptable Example |

*1hot dip aluminizing coating weight: 50 g/m$^2$
*2zinc-aluminum hot dipping (Al: 55 mass %) coating weight: 75 g/m$^2$
*3zinc-aluminum hot dipping (Al: 5 mass %) coating weight: 60 g/m$^2$

TABLE 4

| No. | Conversion treating property | Hot-dipping properties: Hot-dipping property | Hot-dipping properties: Plating adhesion property | Alloyed hot-dipping properties: Alloying rate | Alloyed hot-dipping properties: Alloyed appearance | Remarks |
|---|---|---|---|---|---|---|
| 1 | ○ | 5 | ○ | ○ | ○ | Acceptable Example |
| 2 | " | " | " | " | " | Acceptable Example |
| 3 | not | " | " | " | " | Acceptable Example |
| 4 | evaluated | " | " | " | " | Acceptable Example |
| 5 | | " | " | " | " | Acceptable Example |
| 6 | | " | " | " | " | Acceptable Example |
| 7 | | " | " | " | " | Acceptable Example |
| 8 | | " | " | " | " | Acceptable Example |
| 9 | ○ | " | " | " | " | Acceptable Example |
| 10 | " | " | " | " | " | Acceptable Example |
| 11 | X | 5 | ○ | ○ | X | Comparative Example |
| 12 | " | 3 | X | ○ | " | Comparative Example |
| 13 | not | 2 | " | X | " | Comparative Example |
| 14 | evaluated | 2 | " | " | " | Comparative Example |
| 15 | | 1 | " | " | " | Comparative Example |
| 16 | | 2 | " | " | " | Comparative Example |
| 17 | | 3 | " | " | " | Comparative Example |
| 18 | | 3 | " | " | " | Comparative Example |
| 19 | | 1 | " | " | " | Comparative Example |
| 20 | | 1 | " | " | " | Comparative Example |

TABLE 5

| No. | Conversion treating property | Hot-dipping properties: Hot-dipping property | Hot-dipping properties: Plating adhesion property | Alloyed hot-dipping properties: Alloying rate | Alloyed hot-dipping properties: Alloyed appearance | Remarks |
|---|---|---|---|---|---|---|
| 21 | ○ | 4 | ○ | ○ | ○ | Acceptable Example |
| 22 | " | 5 | " | " | " | Acceptable Example |
| 23 | " | " | " | " | " | Acceptable Example |
| 24 | " | " | " | " | " | Acceptable Example |
| 25 | " | " | " | " | " | Acceptable Example |
| 26 | not | 4 | " | not | not | Acceptable Example |
| 27 | evaluated | 5 | " | eval- | eval- | Acceptable Example |
| 28 | | " | " | uated | uated | Acceptable Example |
| 29 | | " | " | | | Acceptable Example |
| 30 | | " | " | | | Acceptable Example |
| 31 | | " | " | | | Acceptable Example |
| 32 | | " | " | | | Acceptable Example |
| 33 | | " | " | | | Acceptable Example |
| 34 | | " | " | | | Acceptable Example |
| 35 | | " | " | | | Acceptable Example |
| 36 | | " | " | | | Acceptable Example |
| 37 | ○ | " | " | ○ | ○ | Acceptable Example |
| 38 | " | " | " | " | " | Acceptable Example |
| 39 | " | 4 | " | " | " | Acceptable Example |
| 40 | " | 5 | " | " | " | Acceptable Example |

TABLE 6

| | Treating liquid | Treating temperature | Treating time |
|---|---|---|---|
| Degreasing | made by Nippon Perker Co., Ltd. (FC-L4460) | 40–45° C. | spraying for 120 seconds |
| Washing with water | — | R. T. | 30 seconds |
| Surface adjustment | made by Nippon Perker Co., Ltd. (PN-Z) | R. T. | immersion for 15 seconds |
| Chemical conversion | made by Nippon Perker Co., Ltd. (PB-L3020) | 40–43° C. | immersion for 120 seconds |

As seen from Tables 4 and 5, all of the hot rolled steel sheets obtained according to the invention show excellent conversion treating property, hot-dipping property and alloyed hot-dipping property as compared with the hot rolled steel sheets obtained by the conventional method because the outermost surface layer is an iron layer decreasing a solid solution amount of an easily-oxidizable metallic element.

Example 2

A steel slab adjusted to a chemical composition shown in Table 7 is heated to 1200–1250° C. and then hot rolled to obtain a hot rolled steel sheet of 3.5 mm in thickness, which is subjected to a heat treatment for hot rolled steel sheet under conditions shown in Tables 8 and 9 and pickled and cold-rolled to obtain a cold rolled steel sheet.

The thus obtained cold rolled steel sheet is subjected to a recrystallization annealing of 830° C. and 1 minute and further to a galvanizing treatment under conditions of bath temperature: 470° C.

sheet entry temperature: 470° C

Al content: 0.14 mass % coating weight: 60 g/m$^2$(one-side surface)

dipping time: 1 second to produce a galvanized steel sheet. And also, a part of the sheet is subjected to an alloying treatment to obtain an alloyed galvanized steel sheet.

Further, a part of the sheet after the above recrystallization annealing is subjected to a hot dip aluminizing and zinc-aluminum hot dipping.

And also, a part of the cold rolled steel sheet is subjected to a conversion treatment to evaluate the conversion treating property.

For the comparison, a cold rolled steel sheet, a hot-dipped steel sheet and an alloyed hot-dipped steel sheet are produced according to the conventional method.

The conversion treating property with respect to the thus obtained cold rolled steel sheets, hot-dipping property and plating adhesion property with respect to various hot-dipped steel sheets, and alloying rate and alloyed unevenness with respect to the alloyed galvanized hot rolled steel sheets, enriched state of Mn or Si in the surface layer portion of the iron matrix and ratios of Mn/Fe, Si/Fe in the surface layer portion of the iron matrix to Mn/Fe, Si/Fe in the inside of the iron matrix are measured to obtain results as shown in Tables 10 and 11.

Moreover, the evaluations of the conversion treating property, hot-dipping property, plating adhesion property, alloying rate and alloyed unevenness are the same as in Example 1, and an enriched profile of Mn, Si in the surface layer portion is evaluated as follows.

<Enriched Profile of Mn, Si in Surface Layer Portion of Iron Matrix>

The enriched state of Si or Mn is detected by measuring element distribution in a depth direction from the surface of the dipped layer to the inside of the iron matrix through GDS.

TABLE 8

| No. | Steel symbol | Presence or absence of black skin scale | Annealing atmosphere of hot rolled steel sheet | Annealing conditions of hot rolled steel sheet | Remarks |
|---|---|---|---|---|---|
| 1 | A | presence | 100% $N_2$ | 750° C., 10 h | Acceptable Example |
| 2 | B | " | " | " | Acceptable Example |
| 3 | C | " | " | " | Acceptable Example |
| 4 | D | " | " | " | Acceptable Example |
| 5 | E | " | " | " | Acceptable Example |
| 6 | F | " | " | " | Acceptable Example |
| 7 | G | " | " | " | Acceptable Example |
| 8 | H | " | " | " | Acceptable Example |
| 9 | I | " | " | " | Acceptable Example |
| 10 | J | " | " | " | Acceptable Example |
| 11 | A | presence | 100% $N_2$ | 980° C., 10 h | Comparative Example |
| 12 | B | " | " | 600° C., 10 h | Comparative Example |
| 13 | C | " | 100% $H_2$ | 750° C., 10 h | Comparative Example |
| 14 | D | " | 5% $H_2$—$N_2$ | " | Comparative Example |
| 15 | E | " | none | none | Comparative Example |
| 16 | F | absence | 100% $H_2$ | 750° C., 10 h | Comparative Example |
| 17 | G | absence | none | none | Comparative Example |
| 18 | H | " | " | " | Comparative Example |
| 19 | I | " | " | " | Comparative Example |
| 20 | J | " | " | " | Comparative Example |

TABLE 7

| Steel | Chemical composition (mass %) | | | | | | | | | | | | | |
|---|---|---|---|---|---|---|---|---|---|---|---|---|---|---|
| symbol | C | Si | Mn | Al | P | S | N | Ti | Nb | B | Mo | Cu | Ni | Sb |
| A | 0.0020 | <0.01 | 0.70 | 0.035 | 0.040 | 0.004 | 0.001 | — | — | — | — | — | — | — |
| B | 0.0020 | — | 0.70 | 0.035 | 0.040 | 0.004 | 0.001 | 0.040 | 0.010 | 0.0008 | — | — | — | 0.008 |
| C | 0.0020 | 0.30 | 1.00 | 0.040 | 0.008 | 0.008 | 0.002 | 0.010 | 0.025 | 0.0010 | — | — | — | 0.010 |
| D | 0.0020 | 0.50 | 1.50 | 0.035 | 0.080 | 0.010 | 0.002 | — | 0.040 | 0.0030 | — | — | — | 0.007 |
| E | 0.0030 | 1.05 | 2.10 | 0.050 | 0.100 | 0.011 | 0.003 | 0.070 | — | 0.0040 | — | — | — | — |
| F | 0.0015 | 0.30 | 1.00 | 0.030 | 0.010 | 0.005 | 0.003 | 0.050 | 0.008 | — | — | 0.5 | 0.3 | — |
| G | 0.08 | — | 1.90 | 0.029 | 0.070 | 0.004 | 0.002 | — | 0.10 | — | — | — | — | 0.006 |
| H | 0.08 | — | 2.10 | 0.035 | 0.008 | 0.008 | 0.002 | — | — | — | 0.30 | — | — | — |
| I | 0.15 | 1.50 | 1.50 | 0.050 | 0.010 | 0.010 | 0.003 | — | — | 0.0010 | — | — | — | 0.010 |
| J | 0.10 | 0.50 | 1.90 | 0.030 | 0.008 | 0.008 | 0.002 | 0.15 | — | — | — | — | — | — |

TABLE 9

| No. | Steel symbol | Presence or absence of black skin scale | Annealing atmosphere of hot rolled steel | Annealing conditions of hot rolled steel sheet | Remarks |
|---|---|---|---|---|---|
| 21 | A | presence | 2% $H_2$—$N_2$ | 750° C., 10 h | Acceptable Example |
| 22 | " | " | 100% $N_2$ | 800° C., 15 h | Acceptable Example |
| 23 | " | " | 99.95% $N_2$-500 ppm $O_2$ | 900° C., 8 h | Acceptable Example |
| 24 | " | " | 100% $N_2$ | 950° C., 5 h | Acceptable Example |
| 25 | B | " | " | 650° C., 10 h | Acceptable Example |
| 26 | " | " | 2% $H_2$—$N_2$ | 800° C., 20 h | Acceptable Example |
| 27 | " | " | 100% $N_2$ | 700° C., 10 h | Acceptable Example |
| 28 | C | " | " | 850° C., 8 h | Acceptable Example |
| 29 | " | " | " | 900° C., 10 h | Acceptable Example |
| 30 | " | " | " | 700° C., 35 h | Acceptable Example |
| 31 | D | " | " | 700° C., 7 h | Acceptable Example*1 |
| 32 | " | " | " | 800° C., 7 h | Acceptable Example |

TABLE 9-continued

| No. | Steel symbol | Presence or absence of black skin scale | Annealing atmosphere of hot rolled steel | Annealing conditions of hot rolled steel sheet | Remarks |
|---|---|---|---|---|---|
| 33 | E | " | " | 900° C., 7 h | Acceptable Example |
| 34 | " | " | " | 700° C., 15 h | Acceptable Example*2 |
| 35 | F | " | " | 750° C., 10 h | Acceptable Example*3 |
| 36 | G | " | " | 750° C., 5 h | Acceptable Example |
| 37 | H | " | " | 800° C., 15 h | Acceptable Example |
| 38 | I | " | " | 950° C., 8 h | Acceptable Example |
| 39 | J | " | 2% $H_2$—$N_2$ | 650° C., 15 h | Acceptable Example |
| 40 | J | " | 100% $N_2$ | 700° C., 9 h | Acceptable Example |

*1hot dip aluminizing coating weight: 50 g/m$^2$

*2zinc-aluminum hot dipping (Al: 55 mass %) coating weight: 75 g/m$^2$

*3zinc-aluminum hot dipping (Al: 5 mass %) coating weight: 60 g/m$^2$

TABLE 10

| | | Hot-dipping properties | | Alloyed hot-dipping properties | | Enriched state of Mn, Si in the vicinity of surface layer of iron matrix | | | |
|---|---|---|---|---|---|---|---|---|---|
| No. | Conversion treating property | Hot-dipping property | Plating adhesion property | Alloying rate | Alloyed appearance | Presence or absence of enriched Mn, Si | Mn/Fe | Si/Fe | Remarks |
| 1 | ○ | 5 | ○ | ○ | ○ | enriched Mn | 1.02 | — | Acceptable Example |
| 2 | not | " | " | " | " | " | 1.02 | — | " |
| 3 | evaluated | " | " | " | " | enriched Mn, Si | 1.03 | 1.05 | " |
| 4 | | " | " | " | " | " | 1.04 | 1.15 | " |
| 5 | | " | " | " | " | " | 1.05 | 1.20 | " |
| 6 | | " | " | " | " | " | 1.02 | 1.06 | " |
| 7 | | " | " | " | " | enriched Mn | 1.03 | — | " |
| 8 | | " | " | " | " | " | 1.04 | — | " |
| 9 | | " | " | " | " | enriched Mn, Si | 1.03 | 1.22 | " |
| 10 | | " | " | " | " | " | 1.04 | 1.08 | " |
| 11 | x | 5 | ○ | ○ | x | enriched Mn | 1.01 | — | Comparative Example |
| 12 | not | 3 | x | ○ | " | none | 1.00 | — | " |
| 13 | evaluated | 2 | " | x | " | " | " | 1.00 | " |
| 14 | | 2 | " | " | " | " | " | " | " |
| 15 | | 1 | " | " | " | " | " | " | " |
| 16 | | 2 | " | " | " | " | " | " | " |
| 17 | | 3 | " | " | " | " | " | — | " |
| 18 | | 3 | " | " | " | " | " | — | " |
| 19 | | 1 | " | " | " | " | " | 1.00 | " |
| 20 | | 1 | " | " | " | " | " | " | " |

TABLE 11

| No. | Conversion treating property | Hot-dipping property | Plating adhesion property | Alloying rate | Alloyed appearance | Presence or absence of enriched Mn, Si | Mn/Fe | Si/Fe | Remarks |
|---|---|---|---|---|---|---|---|---|---|
| | | Hot-dipping properties | | Alloyed hot-dipping properties | | Enriched state of Mn, Si in the vicinity of surface layer of iron matrix | | | |
| 21 | ○ | 4 | ○ | ○ | ○ | enriched Mn | 1.01 | — | Acceptable Example |
| 22 | " | 5 | " | " | " | " | 1.04 | — | " |
| 23 | " | " | " | " | " | " | 1.06 | — | " |
| 24 | " | " | " | " | " | " | 1.06 | — | " |
| 25 | not | " | " | not | not | " | 1.01 | — | " |
| 26 | evaluated | 4 | " | evaluated | evaluated | " | 1.02 | — | " |
| 27 | | 5 | " | | | " | 1.03 | — | " |
| 28 | | " | " | | | enriched Mn, Si | 1.04 | 1.08 | " |
| 29 | | " | " | | | " | 1.05 | 1.10 | " |
| 30 | | " | " | | | " | 1.02 | 1.07 | " |
| 31 | | " | " | | | " | 1.03 | 1.12 | " |
| 32 | | " | " | | | " | 1.05 | 1.16 | " |
| 33 | | " | " | | | " | 1.05 | 1.90 | " |
| 34 | | " | " | | | " | 1.04 | 1.21 | " |
| 35 | | " | " | | | " | 1.03 | 1.06 | " |
| 36 | | " | " | | | enriched Mn | 1.01 | — | " |
| 37 | | " | " | | | " | 1.05 | — | " |
| 38 | | " | " | | | enriched Mn, Si | 1.05 | 1.80 | " |
| 39 | | 4 | " | | | " | 1.01 | 1.15 | " |
| 40 | | 5 | " | | | " | 1.03 | 1.07 | " |

As seen from Tables 10 and 11, all of the steel sheets obtained according to the invention have a sufficient amount of an internal oxide layer and show the excellent conversion treating property, hot-dipping property and alloyed hot-dipping property as compared with the steel sheets obtained by the conventional method.

Example 3

A steel slab having a chemical composition as shown in Table 12 is treated under conditions shown in Tables 13 and 14 to obtain a cold rolled and annealed steel sheet of 0.7 mm in thickness.

With respect to thus obtained cold rolled and annealed steel sheets, mechanical properties (tensile strength, elongation, r-value, brittle property), state of internal oxide layer, conversion treating property, hot-dipping property and plating adhesion property in galvanization, and alloying rate and alloyed appearance in alloyed galvanization are measured to obtain results as shown in Tables 15 and 16.

Moreover, a part of the steel sheet after the recrystallization annealing is subjected to hot dip aluminizing and zinc-aluminum hot dipping treatments, and thereafter the hot-dipping property and plating adhesion property are measured.

The evaluation method of mechanical properties is carried out as follows.

<Mechanical Properties>

The tensile strength is evaluated by using a tensile testing specimen of JIS No. 5.

And also, r-value is measured by a three-point method after the application of 15% tensile pre-strain, and an average value of L-direction (rolling direction), D-direction (direction of 45° from rolling direction) and C-direction (direction of 90° from rolling direction) is calculated from the following equation:

$$r=(r_L+2r_D+r_C)/4$$

Further, the resistance to secondary working brittleness is evaluated by flange-cutting a conical cup drawn at a drawing ratio of 2.0 and applying an impact load thereto while dropping downward a weight of 5 kg from a height of 80 cm at various temperatures to measure an upper limit temperature causing brittle crack. The temperature of not higher than about −45° C. can be judged as a level causing no problem under usual service environment.

Moreover, the evaluation methods of the other properties are the same as in Example 1.

TABLE 12

| Steel symbol | C | Si | Mn | Al | P | S | N | Ti | Nb | B | Mo | Cu | Ni | Sb | $Ar_3$ transformation point (° C.) |
|---|---|---|---|---|---|---|---|---|---|---|---|---|---|---|---|
| | Chemical composition (mass %) | | | | | | | | | | | | | | |
| A | 0.0025 | — | 0.60 | 0.045 | 0.050 | 0.006 | 0.0015 | — | 0.024 | 0.0010 | — | — | — | — | 900 |
| B | 0.0015 | 0.35 | 0.70 | 0.045 | 0.003 | 0.005 | 0.0010 | 0.070 | 0.015 | 0.0010 | — | — | — | 0.009 | 905 |
| C | 0.0020 | 0.65 | 1.55 | 0.051 | 0.080 | 0.007 | 0.0020 | 0.052 | 0.006 | 0.0025 | — | — | — | — | 900 |
| D | 0.0030 | 1.40 | 2.30 | 0.060 | 0.050 | 0.006 | 0.0020 | 0.062 | — | 0.0030 | 0.50 | 0.60 | 0.45 | — | 870 |
| E | 0.07 | — | 1.70 | 0.045 | 0.010 | 0.009 | 0.002 | — | — | — | — | — | — | — | 830 |
| F | 0.020 | 0.40 | 0.80 | 0.042 | 0.071 | 0.009 | 0.002 | 0.050 | — | — | — | — | — | — | 920 |

TABLE 13

| No. | Steel symbol | Hot rough rolling conditions: finish temperature (° C.) | Hot rough rolling conditions: rolling reduction (%) | Hot finish rolling conditions: finish temperature (° C.) | Hot finish rolling conditions: rolling reduction (%) | Hot finish rolling conditions: lubrication | Black skin scale | Annealing atmosphere of hot rolled steel sheet (vol %) |
|---|---|---|---|---|---|---|---|---|
| 1 | A | 910 | 87 | 650 | 90 | presence | presence | 100% $N_2$ |
| 2 | B | " | 88 | 660 | 89 | " | " | " |
| 3 | C | 930 | " | 670 | 88 | " | " | " |
| 4 | D | 940 | " | 680 | " | " | " | " |
| 5 | A | 910 | 87 | 650 | 90 | " | absence | " |
| 6 | B | 910 | 88 | 660 | 89 | " | presence | 6%$H_2$—$N_2$ |
| 7 | " | " | " | " | " | " | " | 100% $N_2$ |
| 8 | " | " | " | " | " | " | " | " |
| 9 | " | " | " | " | " | " | " | " |
| 10 | " | " | " | " | " | " | " | none |
| 11 | " | " | " | " | " | absence | " | 100% $N_2$ |
| 12 | " | " | " | " | 45 | presence | " | " |
| 13 | " | 990 | " | 910 | 89 | " | " | " |
| 14 | C | 930 | 87 | 700 | 88 | " | absence | " |
| 15 | D | 940 | " | " | " | " | absence | " |
| 16 | E | " | " | " | " | " | presence | " |
| 17 | F | 910 | 88 | 660 | 89 | " | " | " |

| No. | Steel symbol | Annealing conditions of hot rolled steel sheet | Pickling | Cold rolling reduction (%) | Recrystallization annealing conditions after cold rolling | Remarks |
|---|---|---|---|---|---|---|
| 1 | A | 800° C., 10 h | presence | 80 | 850° C., 20 s | Acceptable Example |
| 2 | B | " | " | " | " | " |
| 3 | C | " | " | " | " | " |
| 4 | D | " | " | " | " | " |
| 5 | A | " | absence | " | " | Comparative Example |
| 6 | B | " | presence | " | " | " |
| 7 | " | 980° C., 10 h | " | " | " | " |
| 8 | " | 800° C., 10 h | " | 45 | " | " |
| 9 | " | 600° C., 10 h | " | 80 | " | " |
| 10 | " | none | " | " | " | " |
| 11 | " | 800° C., 10 h | " | " | " | " |
| 12 | " | " | " | " | " | " |
| 13 | " | " | " | " | " | " |
| 14 | C | " | absence | " | " | " |
| 15 | D | " | " | " | " | " |
| 16 | E | " | presence | " | " | " |
| 17 | F | " | " | " | " | " |

TABLE 14

| No. | Steel symbol | Hot rough rolling conditions: finish temperature (° C.) | Hot rough rolling conditions: rolling reduction (%) | Hot finish rolling conditions: finish temperature (° C.) | Hot finish rolling conditions: rolling reduction (%) | Hot finish rolling conditions: lubrication | Black skin scale | Annealing atmosphere of hot rolled steel sheet (vol %) |
|---|---|---|---|---|---|---|---|---|
| 18 | A | 910 | 87 | 650 | 90 | presence | presence | 100% $N_2$ |
| 19 | " | " | " | " | " | " | " | " |
| 20 | " | " | " | " | " | " | " | " |
| 21 | " | " | " | " | " | " | " | 2% $H_2$—$N_2$ |
| 22 | B | 910 | 88 | 660 | 89 | " | " | 100% $N_2$ |
| 23 | " | " | " | " | " | " | " | " |
| 24 | " | " | " | " | " | " | " | " |
| 25 | C | 930 | 88 | 670 | 88 | " | " | " |
| 26 | " | " | " | " | " | " | " | " |
| 27 | " | " | " | " | " | " | " | 2% $H_2$—$N_2$ |
| 28 | D | 940 | 88 | 680 | 88 | " | " | 100% $N_2$ |
| 29 | " | " | " | " | " | " | " | 3% $H_2$—500 ppm $O_2$—$N_2$ |
| 30 | " | " | " | " | " | " | " | 100% $N_2$ |
| 31 | A | 910 | 87 | 650 | 90 | " | " | 1% $O_2$—$N_2$ |
| 32 | " | " | " | " | " | " | " | " |
| 33 | " | " | " | " | " | " | " | " |

TABLE 14-continued

| No. | Steel symbol | Annealing conditions of hot rolled steel sheet | Pickling | Cold rolling reduction (%) | Recrystallization annealing conditions after cold rolling | Remarks |
|---|---|---|---|---|---|---|
| 18 | A | 750° C., 10 h | presence | 85 | 830° C., 1 min | Acceptable Example |
| 19 | " | 900° C., 8 h | " | " | " | " |
| 20 | " | 650° C., 20 h | " | " | " | " |
| 21 | " | 750° C., 10 h | " | 80 | " | " |
| 22 | B | 700° C., 15 h | " | " | " | " |
| 23 | " | 850° C., 7 h | " | " | " | " |
| 24 | " | 900° C., 10 h | " | " | " | " |
| 25 | C | " | " | " | " | " |
| 26 | " | 750° C., 10 h | " | " | " | " |
| 27 | " | 800° C., 10 h | " | " | " | " |
| 28 | D | 800° C., 20 h | " | " | " | " |
| 29 | " | 800° C., 10 h | " | " | " | " |
| 30 | " | 650° C., 20 h | " | " | " | " |
| 31 | A | 800° C., 10 h | " | " | " | "*1 |
| 32 | " | " | " | " | " | "*2 |
| 33 | " | " | " | " | " | "*3 |

*1hot dip aluminizing coating weight: 50 g/m$^2$
*2zinc-aluminum hot dipping (Al: 55 mass %) coating weight: 80 g/m$^2$
*3zinc-aluminum hot dipping (Al: 4.5 mass %) coating weight: 75 g/m$^2$

TABLE 15

| | Mechanical properties | | | | | | | Hot-dipping properties | | | | |
|---|---|---|---|---|---|---|---|---|---|---|---|---|
| | | | | Brittle | Internal oxide layer | | Conversion | Hot- | Plating | | | |
| No. | T. S. (MPa) | EL. (%) | r-value | property (° C.) | State | Thickness (μm) | treating property | dipping property | adhesion property | Alloying rate | Alloyed appearance | Remarks |
| 1 | 350 | 45 | 2.8 | −50 | presence in grain and grain boundary | 35 | ○ | 5 | ○ | ○ | ○ | Acceptable Example |
| 2 | 355 | 44 | 2.7 | " | presence in grain and grain boundary | 25 | ○ | " | ○ | ○ | ○ | Acceptable Example |
| 3 | 455 | 38 | 2.5 | " | presence in grain and grain boundary | 20 | ○ | " | ○ | ○ | ○ | Acceptable Example |
| 4 | 600 | 31 | 2.4 | " | presence in grain and grain boundary | 15 | ○ | " | ○ | ○ | ○ | Acceptable Example |
| 5 | 352 | 43 | 2.8 | " | absence | 0 | x | 3 | ○ | x | ○ | Comparative Example |
| 6 | 357 | 44 | 2.6 | " | presence in grain boundary | 2 | x | " | ○ | x | ○ | Comparative Example |
| 7 | 351 | 42 | 1.3 | " | presence in grain and grain boundary | 80 | ○ | 5 | ○ | x | x | Comparative Example |
| 8 | 345 | 41 | 1.4 | " | presence in grain and grain boundary | 24 | ○ | " | ○ | ○ | ○ | Comparative Example |
| 9 | 354 | 44 | 2.6 | " | presence in grain boundary | 3 | x | 3 | ○ | x | ○ | Comparative Example |
| 10 | 350 | 45 | 1.8 | " | absence | 0 | x | " | ○ | x | ○ | Comparative Example |
| 11 | 349 | 44 | 1.7 | " | presence in grain and grain boundary | 26 | ○ | 5 | ○ | ○ | ○ | Comparative Example |
| 12 | 346 | 45 | 1.9 | " | presence in grain and grain boundary | 25 | ○ | " | ○ | ○ | ○ | Comparative Example |
| 13 | 351 | 44 | 1.8 | " | presence in grain and grain boundary | 24 | ○ | " | ○ | ○ | ○ | Comparative Example |
| 14 | 446 | 37 | 2.4 | " | absence | 0 | x | 2 | x | x | x | Comparative Example |
| 15 | 598 | 30 | 2.3 | " | absence | 0 | x | 1 | x | x | x | Comparative Example |
| 16 | 440 | 37 | 1.0 | " | presence in grain and grain boundary | 30 | ○ | 5 | ○ | ○ | ○ | Comparative Example |
| 17 | 345 | 40 | 1.6 | ±0 | presence in grain and grain boundary | 22 | ○ | " | ○ | ○ | ○ | Comparative Example |

TABLE 16

| | Mechanical properties | | | | | | | Hot-dipping properties | | | | |
|---|---|---|---|---|---|---|---|---|---|---|---|---|
| | | | | Brittle | Internal oxide layer | | Conversion | Hot- | Plating | | | |
| No. | T. S. (MPa) | EL. (%) | r-value | property (° C.) | State | Thickness (μm) | treating property | dipping property | adhesion property | Alloying rate | Alloyed appearance | Remarks |
| 18 | 350 | 45 | 2.8 | −50 | presence in grain and grain boundary | 30 | ○ | 5 | ○ | ○ | ○ | Acceptable Example |
| 19 | " | " | " | " | presence in grain and grain boundary | 39 | ○ | " | ○ | ○ | ○ | Acceptable Example |
| 20 | " | " | " | " | presence in grain and grain boundary | 25 | ○ | " | ○ | ○ | ○ | Acceptable Example |
| 21 | " | " | " | " | presence in grain and grain boundary | 10 | ○ | 4 | ○ | ○ | ○ | Acceptable Example |
| 22 | 355 | 44 | 2.7 | −50 | presence in grain and grain boundary | 20 | ○ | 5 | ○ | ○ | ○ | Acceptable Example |
| 23 | " | " | " | " | presence in grain and grain boundary | 22 | ○ | " | ○ | ○ | ○ | Acceptable Example |
| 24 | " | " | " | " | presence in grain and grain boundary | 8 | ○ | 4 | ○ | ○ | ○ | Acceptable Example |
| 25 | 455 | 38 | 2.5 | −50 | presence in grain and grain boundary | 30 | ○ | 5 | ○ | ○ | ○ | Acceptable Example |
| 26 | " | " | " | " | presence in grain and grain boundary | 15 | ○ | " | ○ | ○ | ○ | Acceptable Example |
| 27 | " | " | " | " | presence in grain and grain boundary | 10 | ○ | 4 | ○ | ○ | ○ | Acceptable Example |
| 28 | 600 | 31 | 2.4 | −50 | presence in grain and grain boundary | 25 | ○ | 5 | ○ | ○ | ○ | Acceptable Example |
| 29 | " | " | " | " | presence in grain and grain boundary | 8 | ○ | 4 | ○ | ○ | ○ | Acceptable Example |
| 30 | " | " | " | " | presence in grain and grain boundary | 13 | ○ | 5 | ○ | ○ | ○ | Acceptable Example |
| 31 | 350 | 45 | 2.8 | −50 | presence in grain and grain boundary | 35 | ○ | " | ○ | — | — | Acceptable Example |
| 32 | " | " | " | " | presence in grain and grain boundary | 35 | ○ | " | ○ | — | — | Acceptable Example |
| 33 | " | " | " | " | presence in grain and grain boundary | 35 | ○ | " | ○ | — | — | Acceptable Example |

As seen from Tables 15 and 16, all of the steel sheets according to the invention are excellent in the mechanical properties but also have a sufficient amount of internal oxide layer in the surface layer portion of the iron matrix, and hence the excellent conversion treating property, hot-dipping property and alloyed hot-dipping property are obtained.

INDUSTRIAL APPLICABILITY

Thus, according to the invention, the hot rolled steel sheet after the hot rolling is subjected to a heat treatment in an atmosphere substantially not causing reduction while being adhered with a black skin scale, whereby an internal oxide layer is formed in the surface layer portion of the iron matrix in the steel sheet and an outermost surface layer of the iron matrix can be rendered into an iron layer decreasing a solid solution amount of an easily-oxidizable metallic element and hence the conversion treating property and hot-dipping property can considerably be improved.

What is claimed is:

1. A method of producing a hot rolled steel sheet by hot rolling a base steel and then subjected to a pickling, wherein the steel sheet after the hot rolling is subjected to a heat treatment at a temperature range of 650–950° C. in a substantially non-reducing atmosphere while being adhered with a black skin scale to form an internal oxide layer in a surface layer portion of an iron matrix of the steel sheet.

2. A method of producing a hot-dipped steel sheet, wherein the surface of the hot rolled steel sheet as claimed in claim 1 is subjected to a hot dipping.

3. A method of producing an alloyed hot-dipped steel sheet, wherein the surface of the hot rolled steel sheet as claimed in claim 1 is subjected to a hot dipping and further to an alloying treatment by heating.

4. A method of producing a cold rolled steel sheet by hot rolling a base steel to be a hot rolled steel sheet and subjecting the hot rolled steel sheet to a pickling, a cold rolling and a recrystallization annealing, wherein the steel sheet after the hot rolling is subjected to a heat treatment at a temperature range of 650–950° C. in a substantially non-reducing atmosphere while being adhered with a black skin scale to form an internal oxide layer in a surface layer portion of an iron matrix of the steel sheet.

5. A method of producing a hot-dipped steel sheet, wherein the surface of the cold rolled steel sheet as claimed in claim 4 is subjected to a hot dipping.

6. A method of producing an alloyed hot-dipped steel sheet, the surface of the cold rolled steel sheet as claimed in claim 4 is subjected to a hot dipping and further to an alloying treatment by heating.

7. A method of producing a cold rolled steel sheet having an excellent workability, wherein a steel comprising C: 0.0005–0.005 mass %, Si: not more than 1.5 mass %, Mn: not more than 2.5 mass %, Al: not more than 0.1 mass %, P: not more than 0.10 mass %, Si: not more than 0.02 mass %, N: not more than 0.005 mass % and one or more of Ti: 0.010–0.100 mass % and the remainder being Fe and inevitable impurities is subjected to a rough hot rolling under a condition of finish rolling temperature: not lower than $Ar_3$ transformation point but not higher than 950° C. and to a hot finish rolling through lubrication rolling under conditions of finish rolling temperature: not lower than 500° C. but not higher than Ar3 transformation point and rolling reduction: not less than 80%, and then a steel sheet after the hot finish rolling is subjected to a heat treatment at a temperature range of 650–950° C. in substantially non-reducing atmosphere while being adhered with a black skin scale to form an internal oxide layer in a surface layer portion of an iron matrix of the steel sheet, pickled to remove the black skin scale, and subjected to a cold rolling at a rolling reduction: 50–90% and further to a recrystallization annealing at a temperature of not lower than a recrystallization temperature but not higher than 950° C.

8. A method of producing a hot-dipped steel sheet having an excellent workability, wherein the surface of the cold rolled steel sheet as claimed in claim 7 is subjected to a hot dipping.

9. A method of producing an alloyed hot-dipped steel sheet having an excellent workability, wherein the surface of the cold rolled steel sheet as claimed in claim 7 is subjected to a hot dipping and further to an alloying treatment by heating.

* * * * *

UNITED STATES PATENT AND TRADEMARK OFFICE

CERTIFICATE OF CORRECTION

PATENT NO. : 6,398,884 B1
DATED : June 4, 2002
INVENTOR(S) : Kazuaki Kyono et al.

It is certified that error appears in the above-identified patent and that said Letters Patent is hereby corrected as shown below:

Title page,
Item [54], change the Title, "METHODS OF PRODUCING STEEL PLATE, HOT-DIP STEEL PLATE AND ALLOYED HOT-DIP STEEL PLATE" to -- METHODS OF PRODUCING STEEL SHEET, HOT-DIP STEEL AND ALLOYED HOT-DIP STEEL SHEET --.

Column 34,
Line 60, change "Si:" to -- S --;
Line 61, after "and" (first occurrence), insert -- Nb: 0.001-0.10 mass% --.

Signed and Sealed this

Twelfth Day of November, 2002

*Attest:*

*Attesting Officer*

JAMES E. ROGAN
*Director of the United States Patent and Trademark Office*